US005264317A

United States Patent [19]

Bagchi et al.

[11] Patent Number: 5,264,317

[45] Date of Patent: Nov. 23, 1993

[54] OXYGEN BARRIER COATED PHOTOGRAPHIC COUPLER DISPERSION PARTICLES FOR ENHANCED DYE-STABILITY

[75] Inventors: Pranab Bagchi, Webster; James L. Edwards, Rochester; Wendell F. Smith, Jr., Fairport; Brian Thomas, Pittsford, all of N.Y.

[73] Assignee: Eastman Kodak Company, Rochester, N.Y.

[21] Appl. No.: 974,768

[22] Filed: Nov. 12, 1992

Related U.S. Application Data

[62] Division of Ser. No. 753,527, Sep. 3, 1991, Pat. No. 5,185,230.

[51] Int. Cl.[5] ..... G03C 1/04

[52] U.S. Cl. ..... 430/138; 430/531; 430/536; 430/543; 430/627; 430/909

[58] Field of Search ..... 430/138, 531, 536, 543, 430/627, 909

[56] References Cited

U.S. PATENT DOCUMENTS

| | | | |
|---|---|---|---|
| 3,277 041 | 10/1966 | Sieg et al. | 260/30.4 |
| 3,936,303 | 2/1976 | Shiba et al. | 430/546 |
| 4,072,527 | 2/1978 | Fan | 430/273 |
| 4,080,209 | 3/1979 | Mukunoki et al. | 430/564 |
| 4,199,363 | 4/1980 | Chen | 430/512 |
| 4,275,145 | 6/1981 | Mikami | 430/377 |
| 4,283,486 | 8/1981 | Aono et al. | 430/505 |
| 4,284,709 | 8/1981 | Tomka | 430/222 |
| 4,291,113 | 9/1981 | Minamizono et al. | 430/202 |
| 4,399,245 | 8/1983 | Kieber et al. | 524/108 |
| 4,409,323 | 10/1983 | Sato et al. | 430/544 |
| 4,542,093 | 9/1985 | Suzuki et al. | 430/523 |
| 4,645,736 | 2/1987 | Anthonsen et al. | 430/538 |
| 4,729,945 | 3/1988 | Anthonsen et al. | 430/538 |
| 4,770,087 | 9/1988 | Takahashi et al. | 430/546 |
| 4,814,260 | 3/1989 | Koboshi et al. | 430/464 |
| 4,933,270 | 6/1990 | Bagchi | 430/546 |
| 4,940,654 | 7/1990 | Diehl et al. | 430/522 |
| 4,990,431 | 2/1991 | Bagchi et al. | 430/372 |
| 5,037,716 | 8/1991 | Moffat | 430/138 |

FOREIGN PATENT DOCUMENTS 56-087038 7/1981 Japan .

*Primary Examiner*—Hoa Van Lee
*Attorney, Agent, or Firm*—Paul A. Leipold

[57] ABSTRACT

The invention creates a selective oxygen barrier around individual coupler or other photographically active particles by surrounding each particle with a layer of water applicable oxygen barrier polymer such as polyvinyl alcohol (PVA), which will also act as a steric barrier to coalescence of the particles. Photographic products formed with such materials are more dye stable.

9 Claims, 5 Drawing Sheets

OXYGEN BARRIER COATED PHOTOGRAPHIC COUPLER DISPERSION PARTICLES FOR ENHANCED DYE-STABILITY

This is a divisional of application Ser. No. 753,527 filed Sep. 3, 1991 now U.S. Pat. No. 5,185,230.

TECHNICAL FIELD

The invention relates to the formation of dispersions of photographic coupler particles and products formed with the dispersions. It more particularly relates to the coating of an oxygen barrier compounds around precipitated photographic coupler dispersion particles to selectively enhance the light and dark stability of photographic agents that fade oxidatively, without excluding oxygen to other layers of a multilayer photographic package that may contain couplers, the dyes of which may fade by a reductive mechanism, and thereby not affecting the dye stability of such other layers.

PRIOR ART

Cyan, magenta, and yellow dyes that create photographic images fade with time, especially when exposed to various ambient lighting conditions such as sunlight, incandescent light, or fluorescent light. Most damage is usually done by UV-radiation that may be present in any lighting source. It is, therefore, desirable to make photographic products, especially photographic paper that is used to display images of both personal and commercial scenes, as stable as possible to fade. There are various means of achieving improved dye stability. Since products such as color paper are high volume products that are highly price sensitive, it is not always commercially feasible to replace an existing coupler with low cost with a new more stable and expensive coupler. Photographic paper structure, as shown in Table I, contains UV-absorbing compound dispersed in protective layers to absorb the damaging UV-radiation and prevent it from reaching the image dyes. Usually such UV-absorbing compounds have slight yellow coloration which, when applied in large enough quantities, cause the paper white areas to appear yellow, which is highly undesirable. Therefore, there is a limit to the extent such UV-absorbing materials could be applied in a photographic product such as paper.

TABLE I

Layer Structure of a Model Multilayer Ektacolor Paper System (Numbers indicate coverage in mg per square ft.) (Numbers within " " indicate same in mg per square meter)

| | |
|---|---|
| | LAYER-7 Overcoat: |
| 125.0 | Gelatin; "1336" |
| 2.0 | (SC-1) (Conventional Scavenger Dispersed in Solvent); "21" |
| | LAYER-6 UV Protection Layer: |
| 61.0 | Gelatin; "653" |
| 34.3 | Tinuvin 328 (Co-dispersed) Ultraviolet light absorber; "364" |
| 5.7 | Tinuvin 326 (Co-dispersed) Ultraviolet light absorber; "60" |
| 4.0 | (SC-1) (Co-dispersed in Solvent); "43" |
| | LAYER-5 Red Layer: |
| 115.0 | Gelatin; "1230" |
| 39.3 | (C-3) (Cyan Cplr. Co-dispersed in Solv.); "420" |
| 0.5 | (SC-1) (Scavenger Co-dispersed in Solvent); "5" |
| 16.7 | AgCl (In Red Sensitized AgCl Emulsion); "179" |

TABLE I-continued

Layer Structure of a Model Multilayer Ektacolor Paper System (Numbers indicate coverage in mg per square ft.) (Numbers within " " indicate same in mg per square meter)

| | |
|---|---|
| | LAYER-4 UV Protection Layer: |
| 61.0 | Gelatin; "653" |
| 34.3 | Tinuvin 328 (Co-dispersed); "364" |
| 5.7 | Tinuvin 326 (Co-dispersed); "60" |
| 4.0 | (SC-1) (Co-dispersed in Solvent); "43" |
| | LAYER-3 Green Layer: |
| 115.0 | Gelatin; "1230" |
| 41.5 | (C-2) (Magenta Coupler Co-dispersed in Solvent); "444" |
| 18.2 | (ST-1) (Stabilizer Co-dispersed in Solvent.: "195" |
| 3.4 | (SC-1) (Scavenger Co-dispersed in Solvent); "37" |
| 24.5 | AgCl (In Green Sensitized AgCl Emulsion); "262" |
| | LAYER-2 Inter Layer: |
| 70.0 | Gelatin; "749" |
| 9.0 | (SC-1) (Scavenger Dispersed in Solvent); "96" |
| | LAYER-1 Blue Layer: |
| 140.0 | Gelatin; "1498" |
| 100.0 | (C-1) (Yellow Coupler Dispersed in Solv.); "1070" |
| 30.0 | AgCl (In Blue Sensitized AgCl Emulsion); "321" |
| Support: | Resin Coat: Titanox Dispersed in Polyethylene Paper |
| | Resin Coat: Polvethylene |

(Structures of compounds indicated in the text later)

Publications such as U.S. Pat. No. 4,283,486—Ano et al and U.S. Pat. No. 3,277,041—Sieg describe oxygen barrier layer comprising polyvinyl alcohol (PVA) that is a very low oxygen permeability, coated on photographic supports to prevent oxidative fade of photographic dyes. PVA has also been used in the photographic and as sizing material for photographic paper, U.S. Pat. No. 4,399,245—Kleber et al; also as subbing of photographic supports, U.S. Pat. No. 4,542,093—Suzuki et al; and in antistatic coatings, U.S. Pat. No. 4,770,487—Takahashi.

Oxygen barrier technology using coated PVA layer is known to work well in multilayer photographic systems where the dyes of all the dye-forming couplers, UV absorbing materials and oxidized developer scavengers in all the layers fade by an ambient oxygen-oxidative mechanism. The dyes of some couplers undergo fade by a reductive mechanism. Therefore, unselective exclusion of oxygen by a universal oxygen barrier will tend to increase the fade of such dyes, of different color if present in the same photographic multilayer packet. Consequently, a selective mode of oxygen exclusion to the individual dyes in the individual layers is both preferred and necessary.

Conventional dispersions of coupler or other photographic addenda are usually prepared by dissolving the compound in a high boiling solvent and then dispersing it in water using a surfactant to stabilize the interface in the presence of the film forming well-known photographic steric stabilizer gelatin, which adsorbs on the surface of the coupler particles and prevents them from coalescence, as described in T. H. James in "The Theory of the Photographic Processes", 4th Edition, MacMillan, N.Y. (1977). Sometimes in such preparation of conventional dispersions, a low boiling water soluble auxiliary solvent is also used, which is washed out of the chilled dispersion or evaporated off after preparation of the dispersion.

There are many methods known in the art where microprecipitated dispersions can be prepared without gelatin present. It has been known in the photographic arts to precipitate photographic materials, such as couplers, from solvent solution. The precipitation of such materials can generally be accomplished by a shift in the content of a water miscible solvent (U.S. Pat. No. 4,933,270—Bagchi) and/or a shift in pH. The precipitation by a shift in the content of water miscible solvent is normally accomplished by the addition of an excess of water to a solvent solution. The excess of water, in which the photographic component is insoluble, will cause precipitation of the photographic component as small particles. The solvent shift method (U.S. 4,933,270—Bagchi) is particularly useful for couplers that are base degradable. In precipitation by pH shift, a photographic component is dissolved in a solvent that is either acidic or basic. The pH is then shifted such that acidic solutions are made basic or basic solutions are made acidic in order to precipitate particles of the photographic component which is insoluble at that pH. United Kingdom Patent 1,193,349—Townsley et al discloses a process wherein an organic solvent, aqueous alkali solution of a color coupler is mixed with an aqueous acid medium to precipitate the color coupler. In an article in *Research Disclosure, December,* 1977, entitled "Process for Preparing Stable Aqueous Dispersions of Certain Hydrophobic Materials", pages 75–80, by William J. Priest, it is disclosed that color couplers can be formed by precipitation of small particles from solutions of the couplers in organic auxiliary solvents. U.S. Pat. No. 4,990,431—Bagchi et al describes a three stream pH shift method for the manufacturing of microprecipitated dispersions in the absence of gelatin. For couplers that need permanent solvent for activity, a similar three stream pH shift method has also been described by Bagchi in U.S. Pat. No. 4,970,139 to obtain a gelatin-free coupler solvent containing microprecipitated coupler dispersions.

It has been shown that when coupler molecules are imbibed into latex particles by dissolving the coupler in a water-miscible solvent, adding this to the latex and removing the solvent, the resultant dispersion produces adequate photographic activity (Chen et al U.S. Pat. Nos. 4,199,363; 4,214,097; 4,133,687 and Tong U.S. Pat. Nos. 2,852,386; 2,772,163) for photographic utility. It seems that the polymer latex acts as a coupler solvent; however, such loading procedure requires very large quantities of solvent, which makes this procedure very expensive and somewhat hazardous for industrial production. In general, such procedure is limited to a load of 3 part coupler and 1 part latex polymer. Prior art (Takaharti European Application 0,256,531) indicates that polymerization or incorporation of a polymer into mechanically ground dispersions with no permanent solvent produces coupler dispersions that give very stable dye images. Also, incorporation of polymer into the photographic layer produces images of high dye stability as indicated in (Matcjeck German Patent 3,520,895). Therefore, it is not clear as to whether the polymer needs to remain in the coupler particle or just in the photographic layer to produce the observed dye stability.

In U.S. Pat. No. 4,490,461—Webb et al describes a process of dispersion preparation by homogenization of a solid solution of a photographic component and a polymer into aqueous gelatin solution by milling procedures. In the process of this invention, a photographic agent and a polymer is dissolved in a solvent. The solvent is then evaporated off to obtain a solid solution. The solid solution is then dispersed in aqueous gelatin by conventional milling procedures. In a specific embodiment this photographic compound is cross-linked to this polymer. This, in some cases is done by a cross-linking agent. The cross-linking may be done via a carboxyl group pendent on the polymer molecule. It is also known that conventional dispersion of photographic couplers can be prepared with some photographic advantages that contain both coupler solvent and a synthetic polyacrylamide polymer (U.S. Pat. No. 4,120,725—Nakazyo et al). In an alternate embodiment of this invention some water soluble acrylamide polymers can be added in aqueous phase along with gelatin for achieving added stability. Surfactant-like polymers containing—$SO_3H$ groups in phenol formaldehyde resins (U.S. Pat. No. 4,198,478 and U.S. Pat. No. 4,569,905) and in acrylate polymers (U.S. Pat. No. 4,291,113) have been used to stabilize milled conventional dispersions.

Other solvent loading techniques like Chen's (U.S. Pat. No. 4,599,363) have been described in Tokitou et al (U.S. Pat. No. 4,358,533 and U.S. Pat. No. 4,368,258). U.S. Pat. No. 4,358,533 describes a process and composition where a photographic material is loaded into a polymer particle by using a large volume of water miscible solvent comprising a polymerized oligomeric material. In a special embodiment, the oligomeric material is polymerized in the presence of the photographic component to form a latex loaded composition. The process of latex loading in U.S. Pat. No. 4,368,258 is quite similar to U.S. Pat. No. 4,199,363—Chen et al. U.S. Pat. No. 2,852,386—Tong describes a very inefficient method of loading of couplers into latex dispersion by stirring the coupler for long periods of time with the latex and filtering off the excess coupler. This procedure led to less than 1 g of coupler per 20 g of the latex polymer in many cases. U.K. 1,456,278 describes loading of ultraviolet radiation absorbing compounds into polymer resin by the use of both permanent and auxiliary solvents in the presence of gelatin.

Chen's (U.S. Pat. No. 4,199,363) process where coupler solubilization and latex swelling are done by a water miscible solvent alone has several disadvantages. The impregnation of latex by the coupler is achieved in the case of Chen by evaporative removal of the solvent. As Chen's method is a solvent shift method, it requires a large amount of water miscible (auxiliary) solvent. By Chen's process, the amount of solvent needed is between 15 to 20 times the weight of the coupler to be imbibed. This is a major drawback of Chen's procedure. In Chen's process the maximum loading is 3 parts coupler to 1 part polymer, whereas higher loading would be desirable. Chen's method requires at least 2% by weight of the monomers to be of the type that form a water soluble polymer. A process that does not have any such requirement would be desirable.

DISCLOSURE OF THE INVENTION

The object of this invention is to create a selective oxygen barrier around individual coupler or other photographically active particles by surrounding each particle with a layer of water applicable oxygen barrier polymer such as polyvinyl alcohol (PVA), which will also act as a steric barrier to coalescence of the particles. In this manner, the dye-forming coupler particles will be surrounded by an oxygen barrier upon drying of the coatings in photographic products. Oxygen can pass through the polyvinyl alcohol particle containing layer to the adjacent layers to aid the dye stability of any reductively fading photographic dyes without affecting the dye stability of the coated particles of the invention.

Conventional dispersions, as described earlier, already have an adsorbed layer of gelatin around the particles. It has been found that addition of PVA to such dispersions will not lead to displacement of the adsorbed gelatin. Microprecipitated slurry (MPS) dispersions as those described by Bagchi U.S. Pat. No. 4,910,431 and U.S. Pat. No. 4,970,139 and polymer coprecipitated (PCP) dispersions as those described in copending U.S. application Ser. No. 543,910 of Bagchi, can be prepared in the presence of oxygen barrier materials such as PVA, which can adsorb on the particle surface and form an oxygen excluding molecular barrier around the dye-forming coupler, or the UV absorber, which is also susceptible to oxidative fade, and thereby reduce their fading behavior.

In an alternate embodiment of the invention the oxygen barrier material, such as PVA, can be added after formation of the dispersion to adsorb on the dispersion particles and coat them. Such a process of this invention is efficient, as the oxygen barrier material does not have to displace gelatin from the particle surface.

MODES OF CARRYING OUT THE INVENTION

Figure 1:
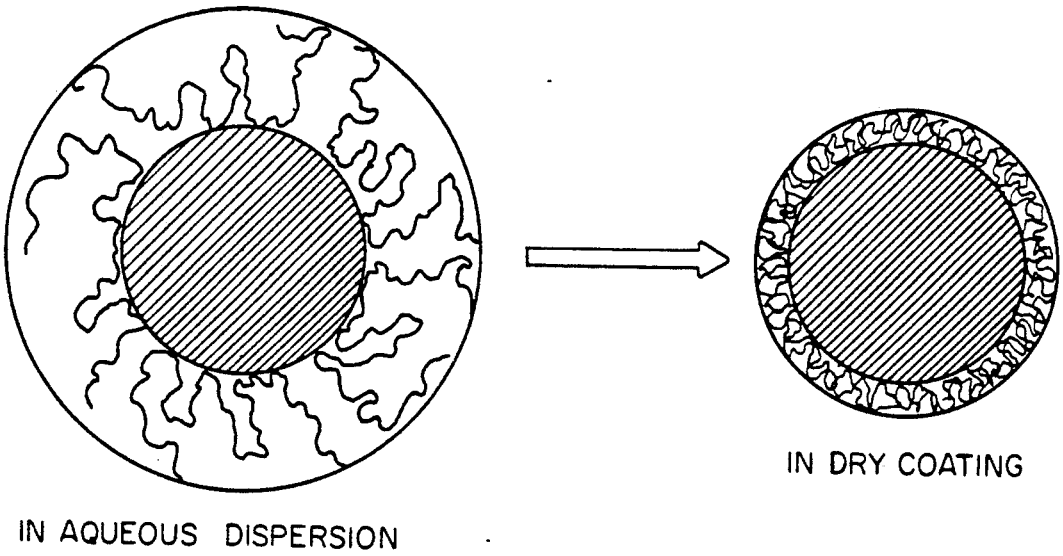
FIG. 1 illustrates a particle of the invention with an oxygen barrier layer in both the hydrated and the dry states.

The advantages of the invention are numerous. The adsorption of oxygen barrier, such as PVA surrounding PCP or MPS coupler dispersion particles prior to the addition of gelatin, can lead to increased resistance for oxidative dye fade of the formed dye in a photographic coating. This invention produces selection protection to dye fade of dye in an individual layer without reducing the dye stability of dyes that are oxidatively stabilized that may be present in the same layer or other layers. Such an oxygen barrier layer around a coupler particle can be produced during or after precipitation of a microprecipitated slurrie (MPS) or polymer coprecipitated (PCP) dispersions.

In one embodiment, the invention is performed by providing a first flow of water, base, a base swellable polymer latex dispersion, a surfactant and a second flow comprising a water miscible auxiliary solvent, base and a the photographically active material such as coupler, bringing together and mixing the said first and the said second flows and then immediately following mixing, neutralizing the said streams to form the dispersion particles. After formation of the particles a flow of an aqueous solution of PVA is mixed with neutralized dispersions to form the PVA coated particles. The PVA coated dispersion particles contain the latex polymer, the photographic material, preferably dye-forming coupler, and the water miscible solvent. The solvent is subsequently washed off by diafiltrations providing particles that only contain essentially the latex polymer, the dye-forming coupler, same surfactant and the coat of the oxygen barrier material. The particles of the invention will be called oxygen barrier coated polymer co-precipitated (PCP) particles. The size of the dispersion particles of the invention are of the same order of magnitude as the particles in the latex dispersion. Such dispersion particles of the invention are generally considerably more active than the conventional milled dispersion of the same coupler containing permanent coupler solvent, and also more fade stable for dyes of couplers that fade by oxylation due to the PVA layer. The particles of this invention may have any diameter between 10 nm (0.01 μm) to 800 nm (0.80 μm). The preferred diameters of the latex particles of this invention are below 200 nm or (0.2 μm).

In an alternate embodiment, the invention is performed by providing a first flow of water, a surfactant and a second flow comprising a water miscible auxiliary solvent, base and the photographically active material such as coupler, bringing together and mixing the said first and the said second flows and then immediately following mixing, neutralizing the said streams to form the dispersion particles. After formation of the particles, a flow of an aqueous solution of PVA is mixed with neutralized dispersions to form the PVA coated particles. Thus are formed the invention oxygen barrier coated microprecipitated slurry (MPS) or dispersions of couplers or other photographic agents. Such microprecipitated dispersion particles of the invention are usually more active than conventional milled dispersions and for dyes of couplers that fade oxidatively such oxygen barrier coated particles produce more fade stable dyes. The diameter of the microprecipitated dispersion of the invention ranges from anywhere between about 5 and about 50 nm.

The hydrated thickness of the oxygen barrier (as measured by Photon Correlation Spectroscopy, PCS (Chu Laser Light Scattering, Academic Press, N.Y., 1974) on polymer coprecipitated (PCP) dispersions or microprecipitated slurrie (MPS) could range from 5 nm to 50 nm. Like the PCP dispersion, the oxygen barrier coated MPS dispersions are cleaned by dialysis or diafiltration to remove the auxiliary solvents.

The invention dispersions are room temperature keepable for very long periods of time compared to conventional gel-containing coupler dispersions that need to be refrigerated. The PCP coprecipitation technique with subsequent coating with oxygen barrier of the invention lends itself to loading ratios of coupler to polymer to any ratio desired. The examples show up to 4 parts coupler, 1 part polymer. In contrast the prior art method of Chen (U.S. Pat. No. 4,199,363) ratios of 1 part polymer and 3 parts coupler is about the maximum loading ratio that can be achieved. Compared to the latex loading method of Chen (U.S. Pat. No. 4,199,363). the PCP (polymer coprecipitated dispersions of this invention) dispersions require a fractional quantity of water-miscible solvent, as solubilization is assisted by ionization with base. This not only is a cost-saving advantage compared to the method of Chen, but much less hazardous, as no solvent stripping is involved. Another advantage is that images produced by the dye-forming coupler dispersions of this invention generally have higher light stability and better fade resistance. Another advantage is that the couplers can be precipitated in large scale (15 kg) at 10% coupler which is in the range of concentration needs for the formulation of standard photographic products. This is a manufacturing advantage.

It is an advantage that no high boiling coupler solvents are needed for the activation of the coupler as long as the invention coupler and latex particle has a glass transition temperature lower than about 50° C. This reduces tackiness and mushiness of the coated film and creates an environmentally safer product.

It is an advantage that the inventive PCP dispersion particles are uniform and have a diameter around 100 nm, a contrast with the milled dispersions which have a broad size distribution and the larger particles may be as large as 1000 nm, which sometimes can contribute to the graininess of a photographic image. The particle size of the narrow distribution particles of the invention are easy and swift to characterize by technique such as photon correlation spectroscopy, which lends to less expense in quality assurance methodology. Further, the invention process is amenable to a continuous process control (less product variability) manufacturing procedure, which can produce large cost savings in high volume products such as color paper.

The invention MPS dispersions formed by pH shift precipitation, coated with an oxygen barrier, are extremely small particles, which often demonstrate very high activity and reactivity in coated photographic film formats.

In the case of oxygen barrier coated PCP dispersions, the invention is practiced in the small scale semicontinuous mode by bringing in a first flow of water, latex polymer, surfactant, the oxygen barrier polyvinyl alcohol (PVA), and base to fill the reaction vessel. Then a second flow of a solution of coupler, base, and auxiliary solvent is added to the reaction vessel, which is being continuously stirred by a mixer. Precipitation of the coupler inside the polymer particle is achieved by a controlled third flow of propionic or acetic acid solution using a pump controlled by a processor, which senses the pH of the reactor and stops delivery of the acid at a pH of 6±0.2. The dispersion is then diafiltered to remove this auxiliary solvent.

In preferred methods, for large scale preparation, the first stream of coupler and base is dissolved in water, and the second stream of the aqueous surfactant base and latex particles may be brought together immediately prior to a centrifugal mixer with addition of acid directly into the mixer. The stream will have a residence time of about 1 to about 30 seconds in the mixer and then be mixed with a flow of the oxygen barrier material in an aqueous solution. When leaving the mixer, they may be diafiltered on line to remove the auxiliary solvent and immediately be processed for utilization in photographic materials. When the process is stopped, the mixer may be shut off with minimum waste of material, as it is only necessary to discard the material in the mixer and pipelines immediately adjacent to it when the process is reactivated after a lengthy shutdown.

The process of the invention produces particles of coupler that are present in water without gelatin. The gelatin-free suspensions of the invention are stable in storage and may be stored at room temperature rather than chilled as are gelatin suspensions.

FIG. 1 shows a schematic view of PVA coated microprecipitated or polymer coprecipitated particle in aqueous dispersion and in a dry coating, where the adsorption layer is dehydrated and shrunk into a compact layer. The thickness of the saturated hydrated adsorption layer on the particles shown in the examples is of the order of 200 Å (or 20 nm). This is of a similar order of magnitude as those for the PVA adsorption layer thickness on AgI (see Bagchi, *J Colloid Interface Science,* Vol. 47, pages 86 and 100, 1974). The adsorbed PVA on particles is of the order of 1–3 mg per sq. m. This is somewhat dependent on molecular weight. These adsorption values translate to 10 to 20 Å (or 2 nm) dry thickness of PVA on the particles, as shown in FIG. 1. Hydrated oxygen barrier layer thickness between 10 to 500 nm is suitable for this invention.

Figure 2:
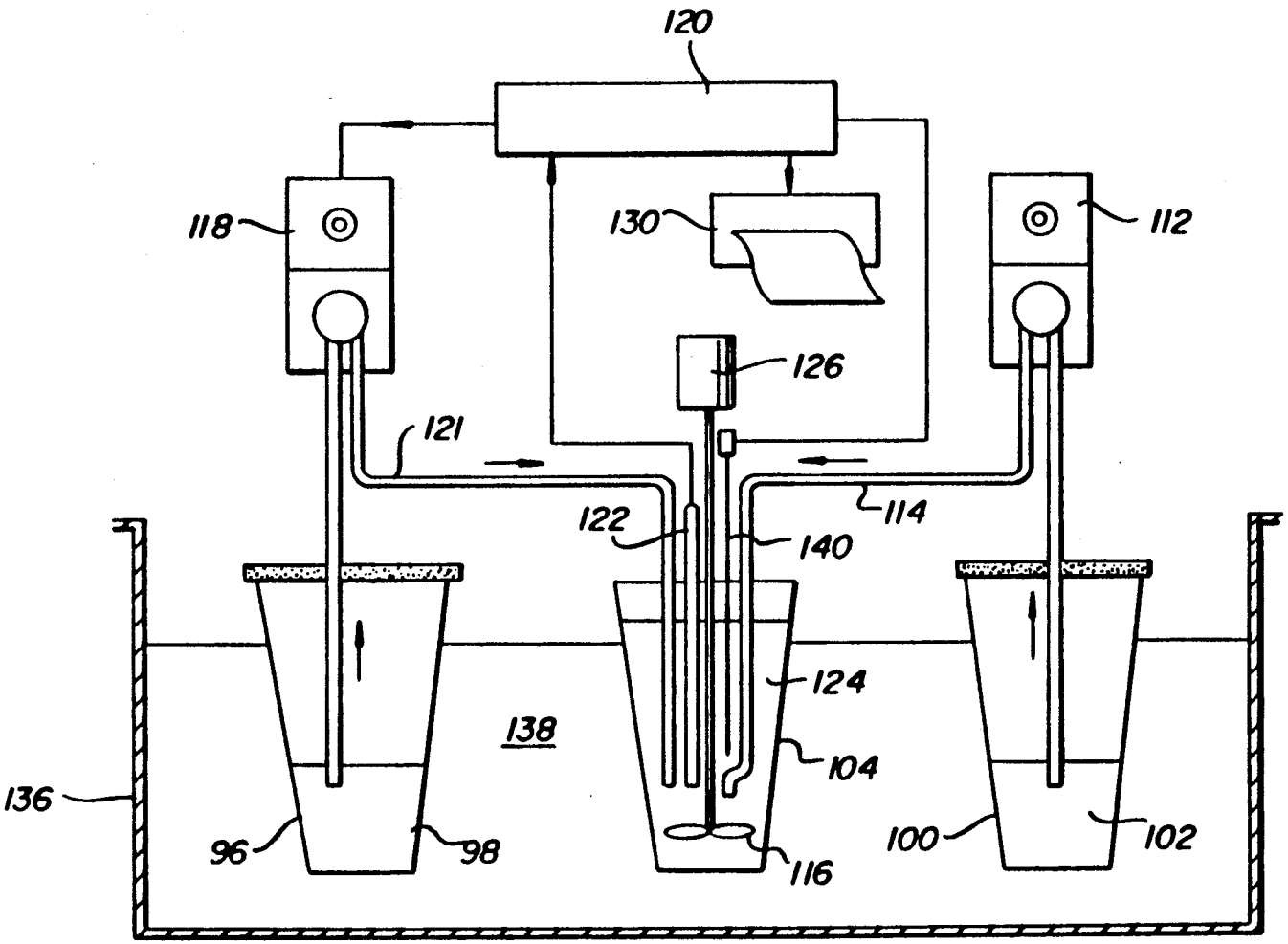
FIG. 2 illustrates equipment for the precipitation of the dispersions of this invention in small scale.

FIG. 2 illustrates the semicontinuous equipment to prepare such dispersions as those of this invention for small laboratory size preparation. This equipment is used for the preparation of the invention dispersion in volumes up to 700 mL, in semicontinuous mode for a total coupler weight of 20 g. Container 104 is provided with an aqueous surfactant solution with the latex polymer, polyvinyl alcohol oxygen barrier material, and some alkali 124. Container 96 is provided with an acid solution 98. Container 100 combines a basic solution 102 of coupler in solvent. Container 104 provides high shear mixing and is the reaction chamber where dispersion formation takes place. The size of the acid kettle 96, the coupler kettle 100, and the reaction kettle are all of about 800 mL in capacity. In the system of FIG. 2, the reactor 104 is initially provided with an aqueous solution of the surfactant, the carboxylated latex, PVA and some alkali to ionize the latexes. The coupler is dissolved in base and a water-miscible solvent generally at an elevated temperature in a separate vessel and then cooled down to room temperature and placed in kettle 100. The dispersion preparation process is started by starting the coupler pump 112, which pumps in basic coupler solution to the reaction chamber 104 under continuous agitation provided by the stirrer 116. The pH is monitored during any stage of the precipitation process using pH meter 120 which is connected to the pH-electrode system 122 and a thermostat probe 140 for temperature sensing. The pH is recorded in the strip chart recorder 130. After the coupler solution has been pumped into the reaction chamber 104, pump 112 is stopped and pump 118 is started to pump acid solution into the reaction chamber 104 via tube 121 for the neutralization and precipitation of the coupler, under vigorous stirring. The acid solution is pumped until the pH of the reaction chamber reaches a pH of 6.0±0.2, at which time this acid pump 118 is shut off. The constant temperature bath 136 is provided to keep the temperature of the three kettles identical. It is usually kept at about room temperature.

Dispersions prepared in this manner are worked by continuous dialysis against distilled water for 24 hours to remove all of the salts and solvent from the formed dispersion.

Figure 3:
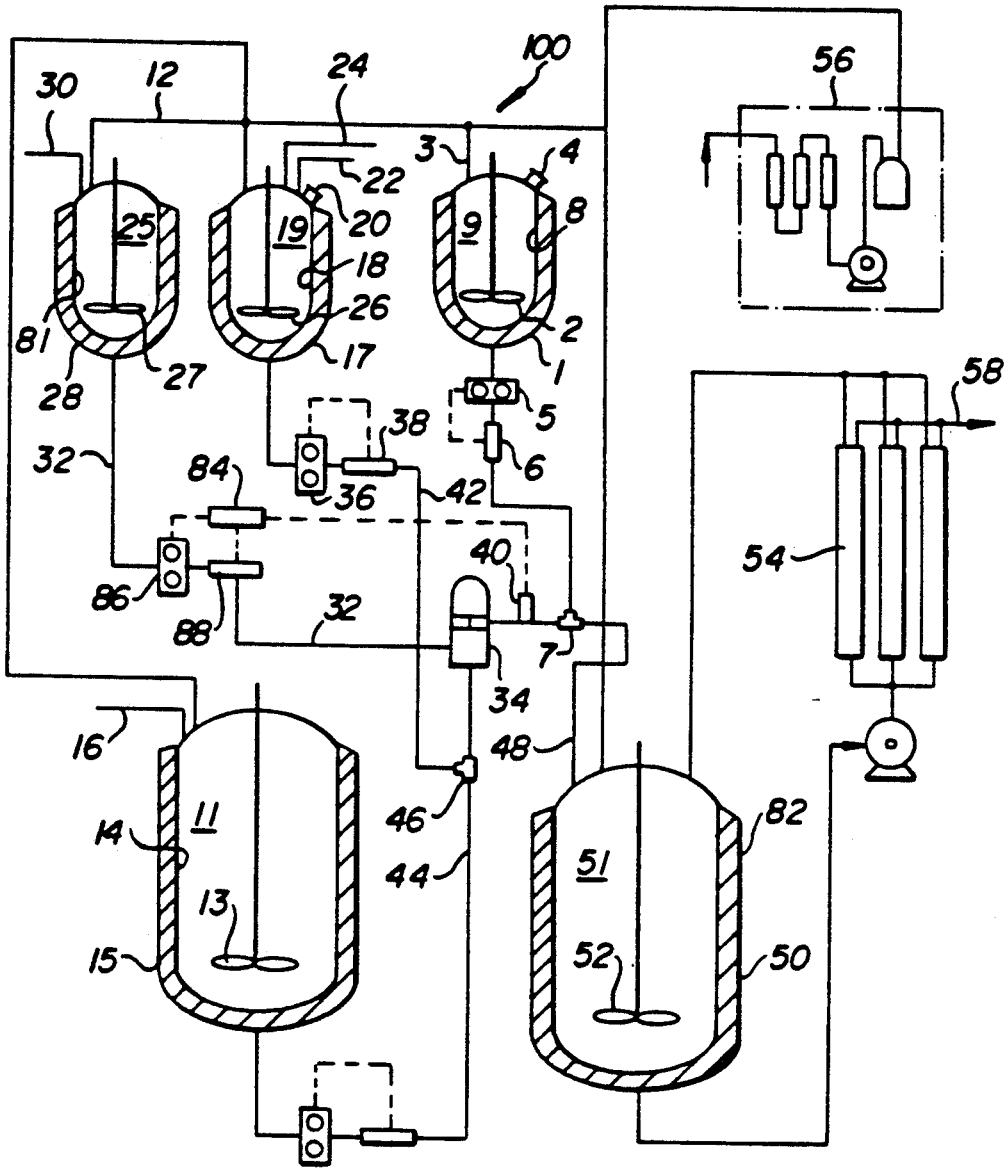
FIG. 3, illustrates equipment for the precipitation of the dispersions of this invention in large scale.

In a large scale (between 1000 and 3000 g of coupler), the apparatus 100 of FIG. 3 is utilized to perform the precipitation process for this invention. The apparatus is provided with high purity water delivery lines 12. Tank 14 contains a suspension 11 of base, surfactant, latex, and high purity water. Jacket 15 on tank 14 regulates the temperature of the tank. Surfactant enters the tank through line 16. Tank 18 contains a photographic component solution 19. Jacket 17 controls the temperature of materials in tank 18. The tank 18 contains a coupler entering through manhole 20, a base material such as aqueous sodium hydroxide solution entering through line 22, and solvent such as n-propanol entering through line 24. The solution is maintained under agitation by the mixer 26. Tank 81 contains acid solution 25 such as propionic acid entering through line 30. The tank 81 is provided with a heat jacket 28 to control the temperature, although with the acids normally used, it is not necessary. In operation, the acid is fed from tank 81 through line 32 to mixer 34 via the metering pump 86 and flow meter 88. A pH sensor 40 senses the acidity of the dispersion as it leaves mixer 34 and allows the operator to adjust the acid pump 86 to maintain the proper pH in the dispersion exiting the mixer 34. The photographic component 19 passes through line 42, metering pump 36, flow meter 38, and joins the basic surfactant-/polymer suspension in line 44 at the "T"-fitting 46. The coupler precipitates into the polymer particles in mixer 34 and exits through pipe 48 into the ultrafiltration tank 82. Before it reaches the ultrafiltration tank 82, it is mixed with the oxygen barrier material, such as PVA, at the "T"-fitting 7. The PVA solution is prepared in jacketed tank 8, which is fed by high purity water through the line 3. PVA is added in through the manhole 4. The solution is prepared by mixing the PVA and water at room temperature for several hours, and then the temperature is raised to close to 100° C. for sufficient time with stirring with stirrer 2 until all the PVA is dissolved. The jacket temperature is then lowered to room temperature to produce PVA solution at room temperature. The PVA solution 9 is pumped into the "T"-mixer by the metering pump 5 via the flow meter 6 to maintain a predetermined ratio of PVA to coupler. In tank 82 the dispersion 51 is held while it is washed by ultrafiltration membrane 54 to remove the solvent and salt from solution and adjust the material to the proper water content for makeup as a photographic component. The source of high purity water is purifier 56. Agitator 13 agitates the surfactant solution in tank 14. Agitator 27 agitates the acid solution in tank 81. The impurities are removed during the ultrafiltration process through permeate (filtrate) stream 58.

The control PCP (U.S. application Ser. No. 543,910) or the MPS dispersion (U.S. Pat. No. 4,990,431) was prepared using the same equipments of FIGS. 2 and 3 except no PVA solutions are used in such preparations.

The auxiliary solvent for dissolving the photographic component may be any suitable solvent that may be utilized in the system in which precipitation takes place by solvent shift and/or acid shift. Typical of such materials are the solvents acetone, methyl alcohol, ethyl alcohol, isopropyl alcohol, tetrahydrofuran, dimethylformamide, dioxane, N-methyl-2-pyrrolidone, acetonitrile, ethylene glycol, ethylene glycol monobutyl ether, diacetone alcohol, etc. A preferred solvent is n-propanol because n-propanol is a good solvent for most couplers and allows the formation of highly concentrated, stable, super saturated solutions of the ionized couplers at room temperature.

The acid and base may be any materials that will cause a pH shift and not significantly decompose the photographic components. The acid and base utilized in the invention are typically sodium hydroxide as the base and propionic acid or acetic acid as the acid, as these materials do not significantly degrade the photographic components and are low in cost.

The polymer particles that are useful for the coprecipitation of couplers are polymer particles that have glass transition temperature less than 50° C. Such polymer particles could be ethylynically linked vinyl addition polymer or condensation polymer particles such as polyesters or polyurethanes.

Such polymer particles should preferably contain at least 0.1% negatively charged monomers either fully ionized, such as a monomer containing a $-SO_3$ group, or base ionizable monomer groups, such as acrylic or methacrylic acid. The preferred composition for such polymers are poly(n-butylacrylate-co-methacrylic acid) with at least 10% of methacrylic acid by weight. The preferred particle diameter of the latex particles are less than 200 nm. However, particles of diameters up to 800 nm can be useful for this invention.

The polyvinyl alcohol polymer generally may be utilized in any effective amount. It is desired that at least a monomolecular layer of PVA be formed on the particles. The amount of polyvinyl alcohol polymer generally is between about 5 and 70 parts by weight per part of photographically active material. It is preferred that between 5 and 30 parts by weight of PVA be utilized per part of coupler.

The surfactants of the invention may be any surfactant that will aid in formation of stable dispersions of particles and preferably is not hydrolyzed by base. Typical of such surfactants are those that have a hydrophobic portion to anchor the surfactant to the particle and a relatively small hydrophilic lead group to allow the adsorption of the oxygen barrier material on the coupler particles. Examples of such surfactants are as follows:

$$CH_3-(CH_2)_{11}-SO_4^-Na^+ \qquad \text{I-1}$$

(Sodium Dodecyl Sulfate)

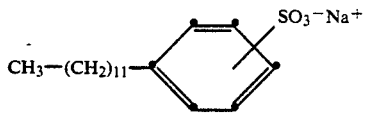

I-2

(Sodium Dodecyl Benzene Sufonate)

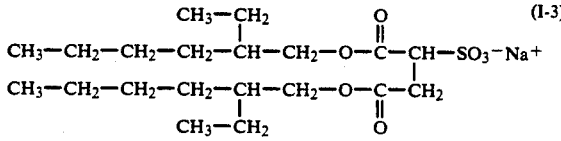

(I-3)

(Aerosol OT Cyanamid)

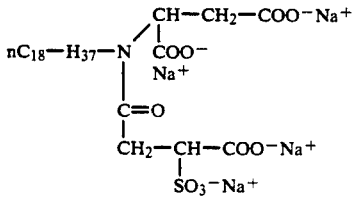

I-4

(Aerosol 22 Cyanamid)

-continued

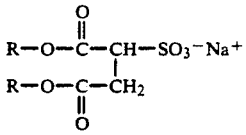

where R = $CH(CH_3)C_4H_9$ (Aerosol MA Cyanamid)

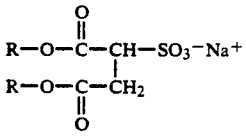

where R = $-CH_2-CH_2-$ 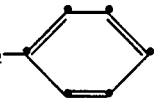

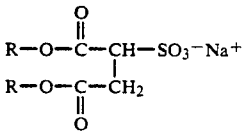

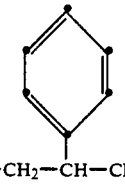

where R = $-CH_2-CH-CH_3$

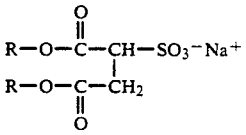

where R = $-CH_2-CH(CH_2CH_3)C_3H_7$

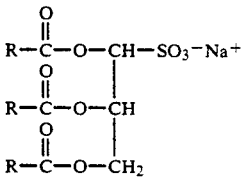

R = $-(CH_2)_nCH_3$(n = 2, 3 & 5)

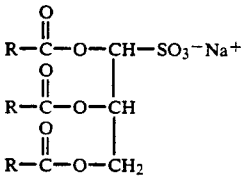

R = $-(CH_2)_n-$ 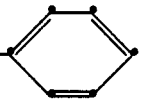 (n = 2 to 5)

Dye-Forming Couplers

-continued

I-5

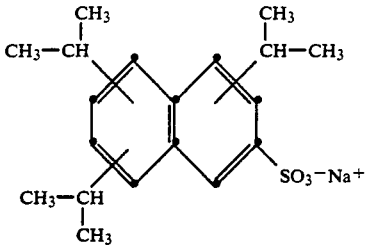

I-6

(Alkanol-XC Dupont)

I-7

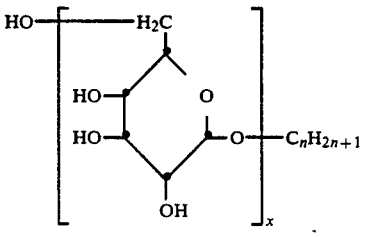

wherein n = 5 to 20 and x = 1 to 4.

(Alkyl Polyglycoside APG, Henkel Corp.)

or

I-8

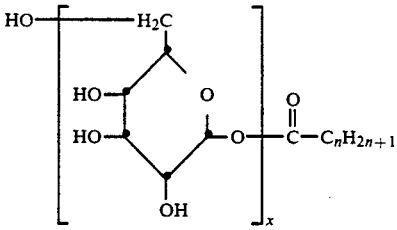

wherein n = 5 to 20 and x = 1 to 4.

(Crodesta, Croda, Inc.)

I-9

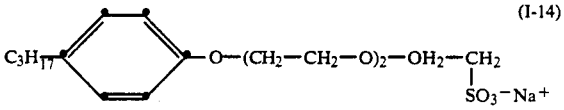

(I-14)

85%

(Tx200E Eastman Kodak Co.)

and

I-10

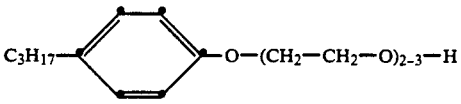

15%

The invention may be practiced with any hydrophobic photographic component that is susceptible to fade that can be solubilized by base and solvent. Typical of such materials are colored dye-forming couplers, filter dyes, UV-absorbing dyes, dye stabilizers, and dyes. Suitable for the process of the invention are the following coupler compounds which have been utilized to form precipitated dispersions:

-continued
C-1
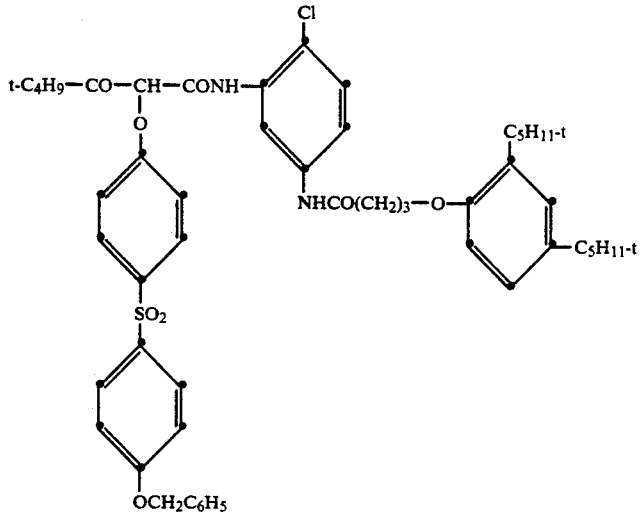
(C-2)
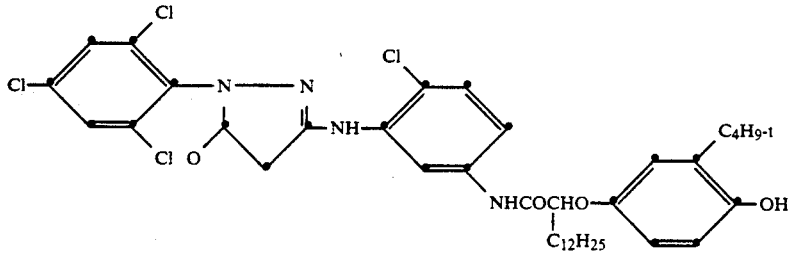
(C-3)
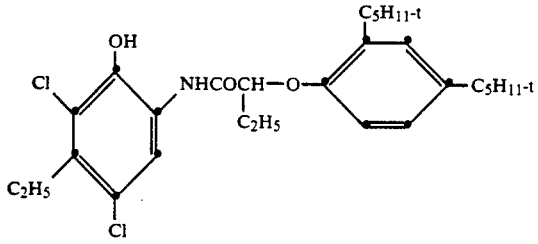
(C-4)
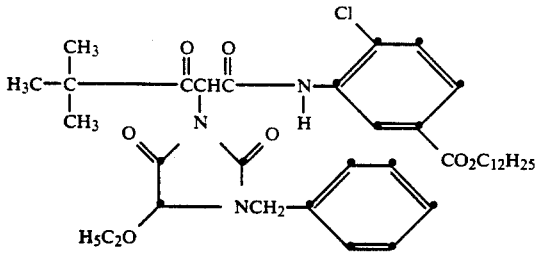
(C-5)
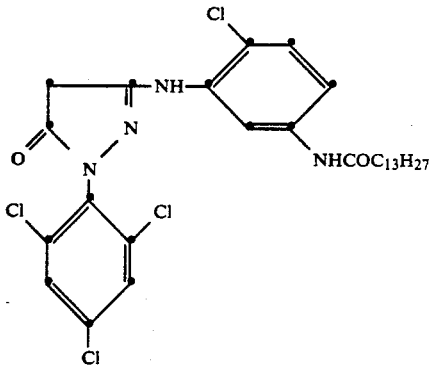

-continued
(C-6)
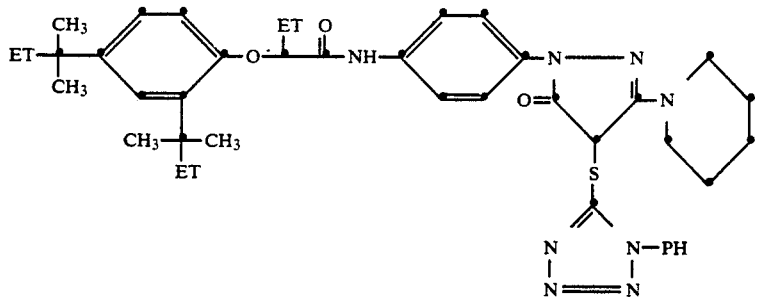
(C-7)
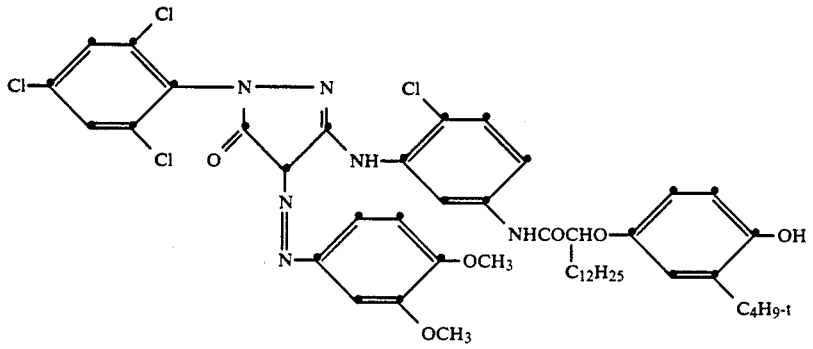
(C-7A)
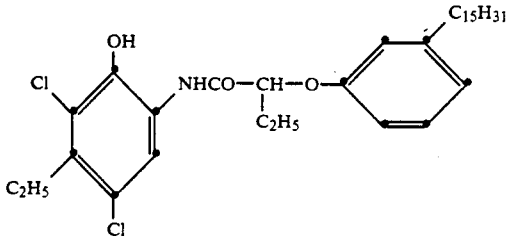
(C-8)
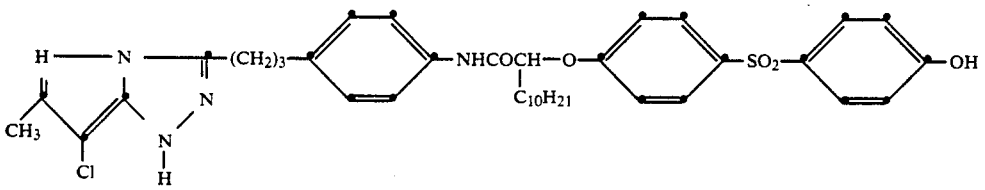
(C-9)
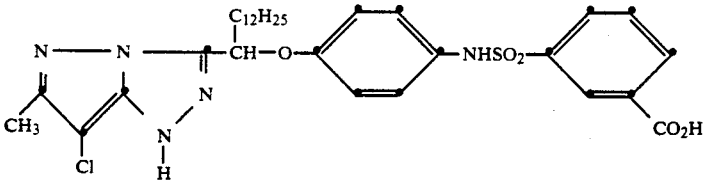
(C-10)
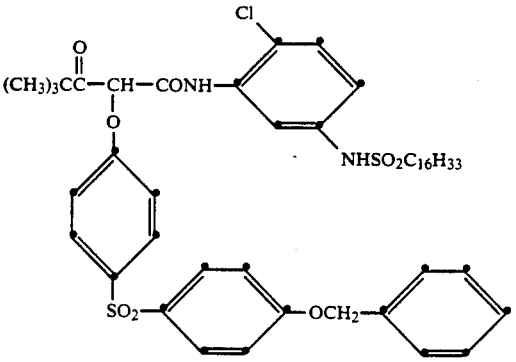

-continued
(C-11)
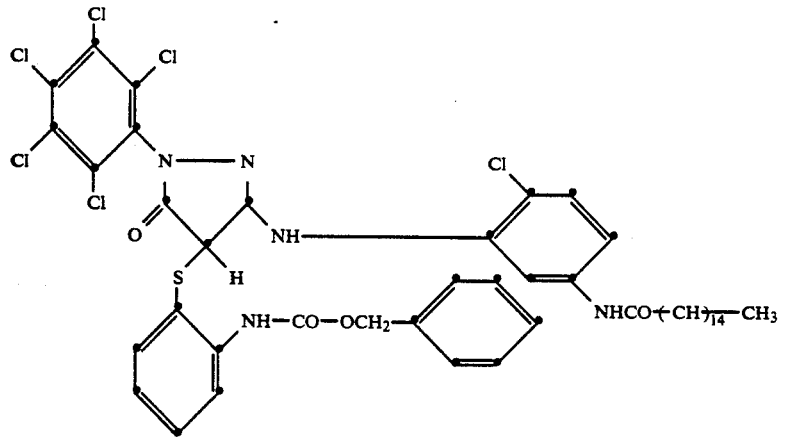
(C-12)
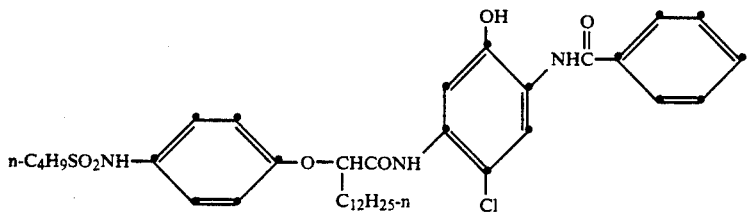
(C-13)
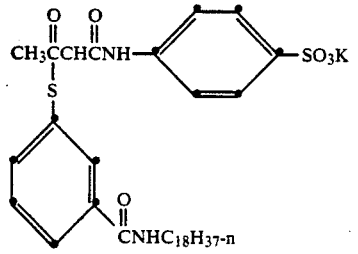
Ultraviolet Absorbers
(C-14)
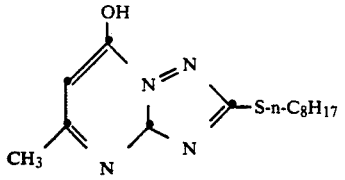
(C-15)
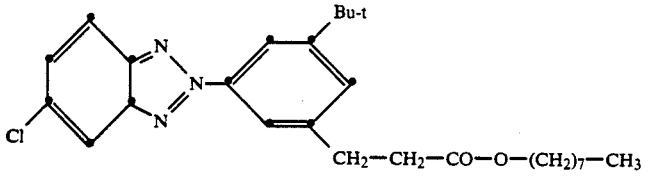
(C-16)
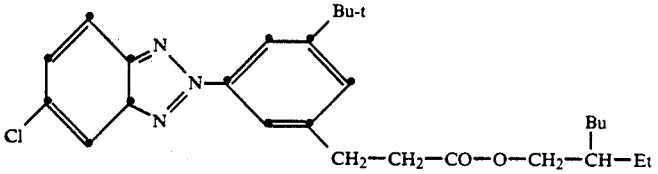

-continued
(C-17)
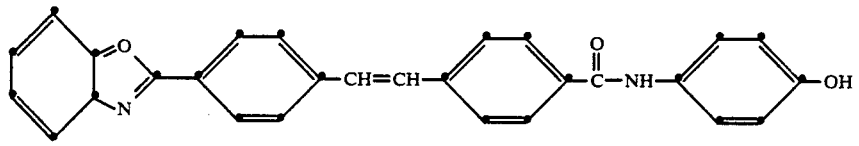
(C-18)
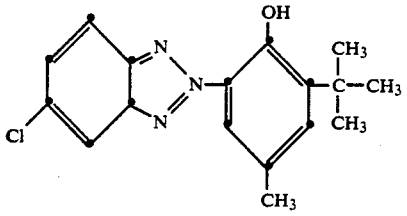
(C-19)
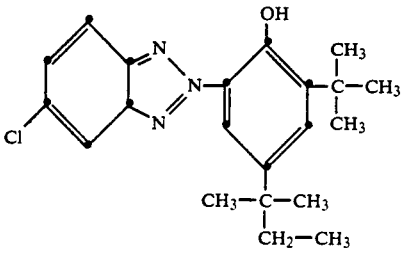
(C-20)
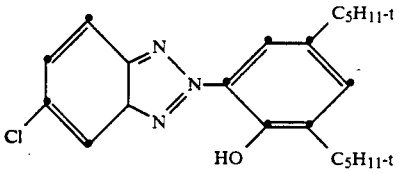
(C-21)
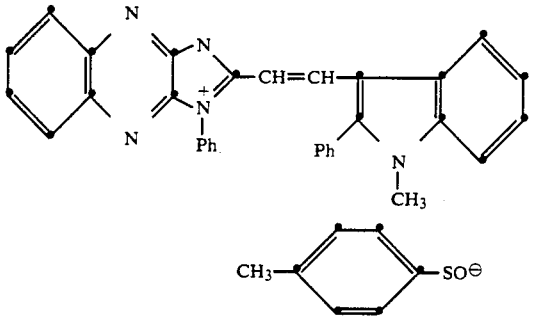
(C-22)
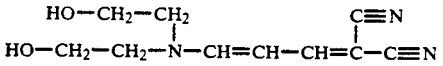
(C-23)
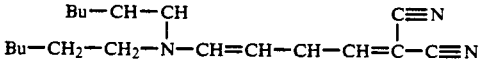
Dye-Stabilizers
(C-24)
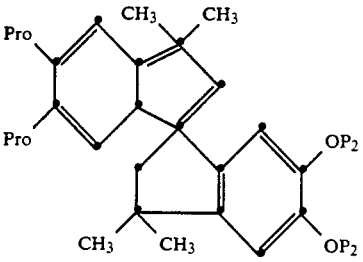

-continued

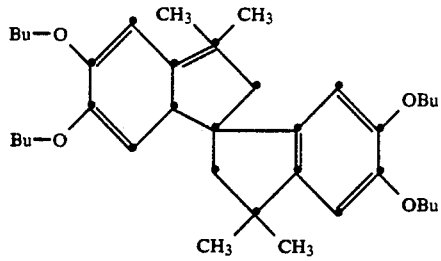

(C-25)

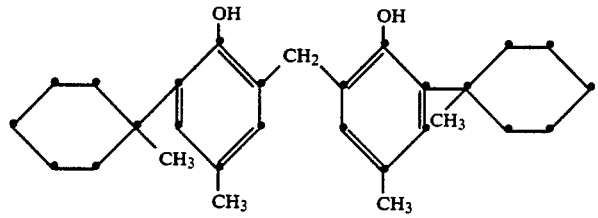

(C-26)

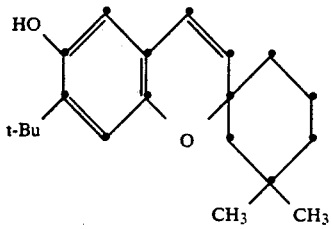

(C-27)

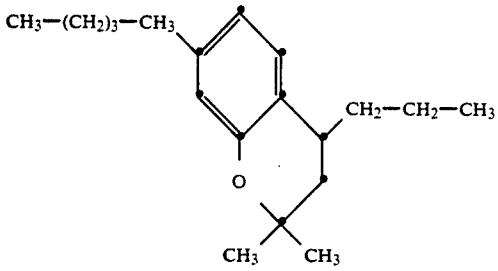

(C-28)

The process of this invention leads to gelatin free, fine particle colloidal dispersions of photographic materials, such as compounds 1-24, that are stable from precipitation for at least several months at room temperature. This is a cost saving feature, as conventional milled dispersions need to be stored under refrigerated conditions.

The mixing chamber, where neutralization takes place, may be of suitable size that has a short residence time and provides high fluid shear without excessive mechanical shear that would cause excessive heating of the particles. In a high fluid shear mixer. the mixing takes place in the turbulence created by the velocity of fluid streams impinging on each other. Typical of mixers suitable for the invention are centrifugal mixers, such as the "Turbon" centrifugal mixer available from Scott Turbon, Inc. of Van Nuys, Calif. It is preferred that the centrifugal mixer be such that in the flow rate for a given process the residence time in the mixer will be of the order of 1-30 seconds. Preferred residence time is 10 seconds or less to prevent particle growth and size variation. Mixing residence time should be greater than 1 second for adequate mixing.

An example of preferred oxygen barrier material is polyvinyl alcohol (PVA) of the following structure:

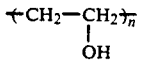

PVA

The preferred molecular weight range is between $10^3$ to $10^7$ Daltons. PVA is prepared by the hydrolysis of polyvinylacetate (PVAC) parent polymer. Therefore, hydrolysis of PVAC to PVA can be controlled to retain some amounts of PVAC in commercial samples. The preferred oxygen barrier PVA samples may contain from 0 to 20% unhydrolyzed PVAC (at least 80 percent hydrolyzed). In an alternate embodiment of this invention, the oxygen barrier material could be any ethyleneically linked copolymer containing at least 10 percent of vinyl alcohol monomer by weight.

Other low molecular weight oxygen barrier such as Sorbitol (D-Glucitol) could also be utilized. Structure of Sorbitol is as follows:

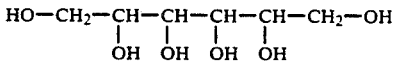

It may be conceived that a milled dispersion can be prepared to conform with the concept of this invention if it is prepared in the absence of gelatin. The procedure of making such a dispersion would be to dissolve the coupler in the coupler solvent and then add it to an aqueous PVA solution containing a surfactant with agitation to form a crude dispersion and then pass it through a colloid mill several times to reduce particle size. In this case PVA would have a chance to adsorb on the dispersion particle surface and produce a monomolecular layer around the particle. It will then be added to a gelled silver halide melt prior to coating. Since displacement of one polymer by another is a slow process, it is expected that most of the PVA molecules will remain on the dispersion particle surface until the construction of the photographic product. In an experiment of this nature, it is expected that the coating will show high dye stability. The diameter of milled dispersion is between 100 to 500 nm.

Description of Measurements and Processing

All particle sizes of the precipitated dispersions were measured by photon correlation spectroscopy (PCS) as described in (B. Chu, "Laser Light-scattering," Academic Press, 1974, New York). Unless otherwise mentioned, all photographic development were carried out by the standard RA-4 color development process described in the anonymous disclosure entitled "Photographic Silver Halide Emulsions, Preparations, Addenda, Processing and Systems," *Research Disclosure*, 308, p. 933-1015 (1989) and Ektacolor Paper System (p. 26, a, b, and c).

EKTACOLOR Paper System

This invention pertains to current EKTACOLOR paper (*Research Disclosure*, Vol. 303, p. 933, 1989) in the full color multilayer structure. The multilayer structure of a model EKTACOLOR paper system is given in Table I. Such coatings are made in a simultaneous multilayer coating machine.

The solvents used in preparation of conventional prior art milled dispersions are as follows:

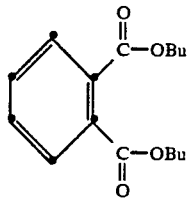
(SV-1)

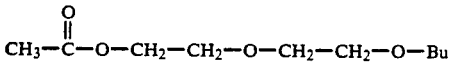
(SV-2)

The proportions of these used in preparation of the dispersions will be given in the examples concerning the prior art milled control dispersions.

The incorporated oxidized developer scavenger used has the following structure:

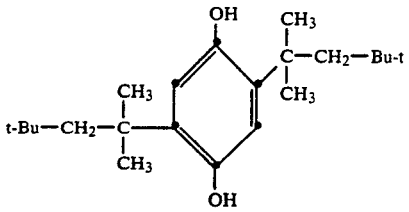
(SC-1)

The stabilizer for the magenta dye has the following structure:

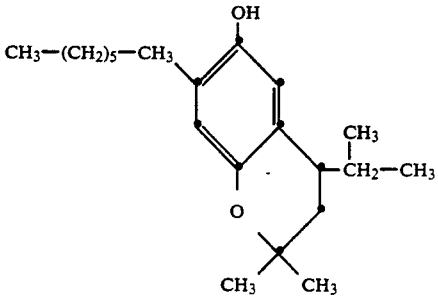
(ST-1)

The ultraviolet radiation absorbing compounds utilized are the two following Ciba-Giegy compounds:

Tinuvin 326

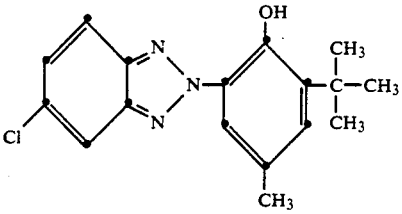
(UV-1)

Tinuvin 328

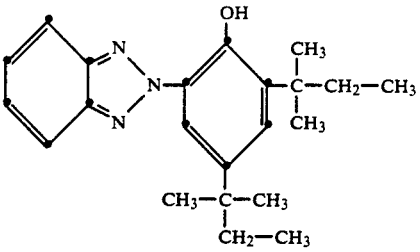
(UV-2)

The specific dispersions prepared with these compounds will be described in detail in the appropriate examples.

The white light exposures of the coated films were made using a sensitometer with properly filtered white light (*Research Disclosure*, Vol. 308, p. 933 1989), with a neutral step wedge of 0.15 neutral density steps. Color separation exposures were made similarly with properly filtered light. All processing was carried out using the well-known RA4 development process (*Research Disclosure*, Vol. 308, p. 933 1989).

EXAMPLES

The following examples are intended to be illustrative and not exhaustive of the invention. Parts and percentages are by weight unless otherwise specified.

Example 1

Preparation of Poly(Butyl acrylate-co-methacrylic Acid) Weight Ratio of Monomers of 80/201 Latex A 22 L three-neck round bottom flask fitted with a condenser and an air stirrer was charged with 16 L of nitrogen purged distilled water and heated to 60° C. in a constant temperature bath. The following were added in the flask:

| | |
|---|---|
| Butyl acrylate | 1280 g |
| Methacrylic acid | 320 g |
| Sodium dodecyl sulfate | 32 g |
| $K_2S_2O_8$ | 32 g |
| $K_2S_2O_5$ | 16 g |

The reaction was carried out under nitrogen for 20 hours at 60° C. Particle diameter of the latex was determined by photon correlation spectroscopy to be 52 nm. Solids of the latex dispersion were measured to be 9.38%.

Example 2

Preparation of PCP Dispersion of Magenta Dye-Forming Coupler (C-2) Using Polymer Latex of Example 1 at a Polymer to Coupler Weight Ratio of 1:1

Preparation of PCP dispersions in small research scale was prepared by using equipment shown in FIG. 2 and that for preparing in large pilot scale is shown in FIG. 3. The pilot scale PCP dispersion of this example of coupler (C-2), which is the magenta coupler of EKTACOLOR Paper was prepared using the equipment of FIG. 3. The coupler solution, surfactant/polymer latex solution, and acid solution were prepared as follows:

| | | |
|---|---|---|
| Coupler Solution: | Coupler (C-2) | 1408 g |
| | 20% NaOH | 352 g |
| | n-propanol | 3521 g |
| | | 5281 g |
| | Flow rate: | 300 g/min |

Above ingredients were mixed together and heated to 45° C. to dissolve the coupler and then cooled to 30° C. before use.

| Surfactant/Polymer Latex Solution: | | |
|---|---|---|
| | Latex of Example 1 | 15000 g |
| | Dupanol C, DuPont | 211 g |
| | 50% NaOH | 19890 g |
| | | 35207 g |
| Acid Solution: | Flow rate: | 2000 g/min |
| | Propionic acid | 375 g |
| | High Purity Water | 2125 g |
| | | 2500 g |

Flow rate: Approximately 80 g/min (adjusted to control the pH of the dispersion between 5.9 to 6.1)

The description of the apparatus set up for this example is as follows:

Temperature-controlled, open-top vessels

Gear pumps with variable-speed drives

The mixer is a high fluid shear centrifugal mixer operated with a typical residence time of about 2 sec.

A SWAGE-LOC "T" fitting where surfactant and coupler streams join

Residence time in pipe between T-fitting and mixer is ≧1 sec.

In-line pH probe is used to monitor pH in the pipe exiting the mixer.

Positive displacement pump for recirculation in batch ultrafiltration

Ultrafiltration membrane is OSMONICS 20 K PS 3' (7.62 cm) by 4" (10.16 cm) spiral-wound permeator The three solutions were continuously mixed in the high-speed mixing device in which the ionized and dissolved coupler is reprotonated causing the precipitation of the coupler into polymer particles. The presence of the surfactant stabilized the formed dispersion particles. The salt by-product of the acid/base reaction is sodium propionate. Ultrafiltration was used for constant-volume washing with distilled water to remove the salt and the solvent (n-propanol) from the crude dispersion. The recirculation rate was approximately 20 gal/min (76 liters/min.) with 50 psi (344 KPa) back pressure which gives a permeate rate of about 1 gal/min. (3.8 liters/min.). The washed dispersion was also concentrated by ultrafiltration to the desired final coupler concentration of 9.85 wt. %. The time to perform the ultrafiltration and produce the final coupler concentration is about 1 hour. Average particle size was 96 nm as measured by photon correlation spectroscopy (PCS). About 10 Kg of such dispersion was recovered.

EXAMPLES 3-6

Polyvinyl Alcohol Adsorbed PCP Dispersion of Coupler (C-2)

Polyvinyl alcohol sold under the name of Airvol-107 by Airproducts, molecular weight range of 11,000 to 31,000 and hydrolysis of 98.0 to 98.8%, was used for preparing the PVA adsorbed PCP dispersions of Examples 3-6. Airvol-107 is a low molecular weight PVA and Airproducts disclosed a viscosity of 6 cp of a 4% solution at 20° C. Two Kg of a 16.6% PVA solution was prepared by adding the dry PVA to distilled water and mixture was stirred for 18 hours at room temperature to swell the PVA granules. The mixture was then heated to 80° C. for 2 hours to completely dissolve the polymer. The solution was then cooled to room temperature where the PVA remained in solution. To prepare the samples of this example, various amounts of the PVA solution was added to pre-weighed amounts of the PCP dispersion of Example 2, as shown in Table II and stirred gently overnight to ensure equilibrium adsorption. The hydrodynamic diameters of each of the PVA containing samples were determined by PCS to determine the hydrated PVA adsorption layer thicknesses on the particles.

TABLE II

| Preparation of the PVA Adsorbed PCP Dispersions of Coupler (C-2) | | | | | | | |
|---|---|---|---|---|---|---|---|
| Example | g of Dispersion of Example 2 | g of 16.6% Airvol-107 | Total Dispersion Weight (g) | Coupler (C-2) Wt. % | PVA to (C-2) Wt. Ratio | Hydro-dynamic Dia. (nm) | Hydrated Thickness of PVA Shell |
| 2 | 200 | 0.0 | 200.0 | 9.85 | 0.00 | 96 | 00 |
| 3 | 200 | 11.8 | 211.8 | 9.30 | 0.10 | 124 | 14 |
| 4 | 1500 | 222.5 | 1722.5 | 8.58 | 0.25 | 137 | 20 |
| 5 | 200 | 35.6 | 235.6 | 8.36 | 0.30 | 139 | 22 |
| 6 | 200 | 59.3 | 259.3 | 7.60 | 0.50 | 139 | 22 |

It is to be noted in Table II that the hydrodynamic adsorption layer thickness of PVA on the PCP particles increased with the amount of PVA added and leveled off around 20 nm (200 Å). It seems that for this sample of PVA, the saturation monomolecular hydrated layer thickness is about 20 nm. Further addition of PVA does not increase the layer thickness as the adsorption of PVA is monomolecular. A monomolecular layer of PVA translates to a dry thickness of about 1 to 2 nm or 10 to 20 Å, for Airvol-107.

EXAMPLES 7, 8, 8A, and 8B

Preparation of Conventional Milled Dispersions Utilized

The conventional milled dispersions of prior art utilized to demonstrate this invention with their compositions are listed in Table-III, and the designated Examples are 7–8. These were prepared by known conventional milling procedures as illustrated in U.S. Pat. No. 3,860,425 of Ono et al. The particle size of such milled prior art dispersions are usually broad and were on the average of diameter of about 200 nm as measured by sedimentation field flow fractionation.

TABLE III

| Compositions of Conventional Dispersions Used in Model EDTACOLOR Paper Coatings | | | | | | | | | | | |
|---|---|---|---|---|---|---|---|---|---|---|---|
| Example | Compound | Compound Wt. % | Coupler Solvent | Wt. % of Coupler Solvent | Surfactant | Wt. % of Surfactant | Stabilizer Compound | Wt. % of Stabilizer Compd. | Wt. % of Gelatin | Wt. % of Water | Comments |
| 7 | (ST-1)<br>(SC-1) | 8.0<br>2.0 | (SV-1)<br>(SV-3) | 4.0<br>6.2 | Alkanol-XC | 1.0 | None | None | 5.0 | 73.6 | Magenta Dye Stabilizer Dispersion |
| 8 | (C-2) | 8.7 | (SV-1) | 8.7 | Alkanol-XC | 1.0 | (ST-1)<br>(SC-1) | 3.7<br>0.9 | 8.7 | 76.2 | Control Magenta coupler dispersion |
| 8A | (UV-2)<br>(UV-1) | 11.8<br>2.1 | None | None | Alkanol-XC | 0.5 | (SC-1) | 1.7 | 7.8 | 75.7 | UV absorbing dispersion |
| 8B | (SC-1) | 6.0 | (SV-1) | 18.0 | Alkanol-XC | 0.2 | None | None | 9.0 | 66.8 | Scavenger Stabilizer dispersion |

It is to be noted that the dispersion of Example - 8A does not contain any coupler solvent. The compounds (UV-1) and (UV-2) at elevated temperatures from an utectic mixture that is liquid and the mixture can be dispersed in aqueous gelatin solution like other conventional dispersions. (SV-3) is ethyl acetate, $CH_3—CO—O—C_2H_5$.

EXAMPLES 9–14

Coating and Evaluations of the PCP Dispersions of Magenta Coupler (C-2) of Examples 2–6 and Control Conventional Dispersion of Example 8

A monochrome magenta model EKTACOLOR paper coating format is shown in Table IV. The control coating using the conventional dispersions of coupler (C-2) (Example 8) was prepared in single hopper coating machine in three passes according to the layer description given in Table IV. The PCP dispersion coatings of Examples 10–14 were prepared using the PCP dispersion of Examples 2–6, along with the conventional stabilizer dispersion of Example 7. Coatings of the PCP dispersion were made at identical coverages as that of the control of Example 9. The finished coatings were exposed to green light using a step wedge and processed by RA-4 processing. The results of the fresh sensitometry of these coatings are listed in Table V. Results of these fresh sensitometry indicate that the PCP dispersions were all quite a bit more active compared to the conventional control as claimed earlier in U.S. Ser. No. 543,910. Otherwise, other photographic parameters such as D-min, gradient and speed appear very similar, within variability of such experiments, to those of the control Example 9, where a conventional dispersion of coupler (C-2) was used. The UV absorber dispersions in all coatings were the same. They were conventional dispersions of Tinuvin 326 and 328 of Example 8A.

The scavenger dispersion was that of Example 8B. For description of RA-4 processing, see *Research Disclosure,* 308, p. 933–1015 (1989).

The dye stability of the coatings of the Examples 9–14 were tested under the following conditions:

* 2 and 4 weeks in High Intensity Daylight, 50 Klux (HID, filtered ultraviolet)
* 2 weeks in High Intensity Sunshine, 50 Klux (HIS, unfiltered ultraviolet)
* 4 weeks dark at 60° C. and 40% RH
* 4 weeks dark at 60° C. and 60% RH The results of the dye fade tests are tabulated in Tables VI and VII. Results indicate that under the tested dark keeping conditions, the PCP dispersion and the one with PVA shell showed similar dye fade and blue D-min gain as the conventional control of Example 8. However, dye fade under lighted conditions (both HID and HIS) were considerably superior, by up to 43% for two-week exposure and about 25% for four-week exposure, for PCP dispersion with a PVA shell of this invention. It is also to be noted from data of Table VII that the dye stability increased with the increase in the addition of PVA and then leveled off. This is due to formation of a saturated monolayer PVA around the particle. The stability of dye to light fade observed was substantial and thus indicates the benefits of the invention.

TABLE IV

Layer Structure of a Model Magenta Monochrome Ektacolor Paper System
(Numbers indicate coverage in mg per square ft.)
(Numbers within " " indicate same in mg per square meter)

| | |
|---|---|
| | LAYER-3 Overcoat: |
| 125.0 | Gelatin; "1336" |
| 2.0 | (SC-1) (Conventional Scavenger Dispersed in Solvent); "21" |
| | LAYER-2 UV Protection Layer: |
| 122.0 | Gelatin; "1305" |
| 68.6 | Tinuvin 328 (Co-dispersed); "734" |
| 11.4 | Tinuvin 326 (Co-dispersed); "122" |
| 8.0 | (SC-1) (Dispersed in Solvent); "86" |
| | LAYER-3 Green Layer: |
| 115.0 | Gelatin; "1230" |
| 41.5 | (C-2) (Magenta Coupler); "444" |
| 18.2 | (ST-1) (Stabilizer); "195" |
| 3.4 | (SC-1) (Scavenger); "37" |
| 26.5 | AgCl (In Green Sensitized AgCl Emulsion); "284" |
| Support: | Resin Coat: Titanox Dispersed in Polyethylene Paper |
| | Resin Coat: Polyethylene |

TABLE V

Fresh Sensitometric Data of the PVA Coated PCP Dispersions of Coupler (C-2)

| Example | Description | g PVA / g (C-2) | Green D-max | Green D-min | Average Gradient | Speed | Hydrated Thickness of PVA Layer (nm) by PCS |
|---|---|---|---|---|---|---|---|
| 9 (Control) | Conventional Example 8 | 0.00 | 2.591 | 0.105 | 2.57 | 202 | 00 |
| 10 | PCP Example 2 | 0.00 | 2.673 | 0.106 | 2.83 | 204 | 00 |
| 11 | PCP Example 3 | 0.10 | 2.655 | 0.108 | 2.75 | 204 | 14 |
| 12 | PCP Example 4 | 0.25 | 2.669 | 0.102 | 2.82 | 204 | 20 |
| 13 | PCP Example 5 | 0.30 | 2.670 | 0.104 | 2.76 | 204 | 22 |
| 14 | PCP Example 6 | 0.50 | 2.642 | 0.106 | 2.80 | 204 | 22 |

TABLE VI

Dye Fade Data of PVA Coated PCP Dispersions of Coupler (C-2)

| Example | Dispersion | g PVA / g (C-2) | HID (4 wks) Δ Density from 1.0 | HID (4 wks) Blue D-Min Gain | HID (2 wks) Δ Density from 1.0 | HID (2 wks) Blue D-Min Gain | HID (2 wks) Δ Density from 1.0 | HID (2 wks) Blue D-Min Gain | 4 Weeks at 60° C./40% RH Δ Density from 1.0 | 4 Weeks at 60° C./40% RH Blue D-Min Gain | 4 Weeks at 60° C./60% RH Δ Density from 1.0 | 4 Weeks at 60° C./60% RH Blue D-Min Gain |
|---|---|---|---|---|---|---|---|---|---|---|---|---|
| 9 (Control) | Conventional Example-8 | 0.00 | −0.70 | 0.07 | −0.30 | 0.02 | −0.29 | 0.11 | −0.07 | 0.02 | −0.07 | 0.02 |
| 10 | PCP Example-2 | 0.00 | −0.66 | 0.05 | −0.22 | 0.02 | −0.26 | 0.06 | −0.04 | 0.02 | −0.04 | 0.02 |
| 11 | PCP Example-3 | 0.00 | −0.62 | 0.05 | −0.22 | 0.02 | −0.24 | 0.05 | −0.06 | 0.03 | −0.06 | 0.03 |
| 12 | PCP Example-4 | 0.25 | −0.65 | 0.05 | −0.21 | 0.03 | −0.25 | 0.05 | −0.05 | 0.03 | −0.05 | 0.03 |
| 13 | PCP Example-5 | 0.30 | −0.60 | 0.04 | −0.21 | 0.02 | −0.25 | 0.05 | −0.05 | 0.03 | −0.05 | 0.03 |
| 14 | PCP Example-6 | 0.50 | −0.61 | 0.05 | −0.21 | 0.03 | −0.22 | 0.05 | −0.06 | 0.03 | −0.06 | 0.03 |

HID: High Intensity Daylight

TABLE VII

High Intensity Daylight Fade of PVA Coated PCP Dispersions of Coupler (C-2)

| Example | Description | g PVA / g (C-2) | 2 Wks Dye Stab. Factor | 4 Wks. Dye Stab. Factor | $t_{30}$ in Weeks | Based on $t_{30}$ |
|---|---|---|---|---|---|---|
| 9 (Control) | Conventional Example-8 | 0.00 | 1.00X | 1.00X | 2.00 | 1.00X |
| 10 | PCP Example-2 | 0.00 | 1.37X | 1.06X | 2.24 | 1.12X |
| 11 | PCP Example-3 | 0.10 | 1.36X | 1.13X | 2.48 | 1.24X |
| 12 | PCP Example-4 | 0.25 | 1.43X | 1.08X | 2.51 | 1.26X |
| 13 | PCP Example-5 | 0.30 | 1.43X | 1.17X | 2.55 | 1.28X |
| 14 | PCP | 0.50 | 1.43X | 1.15X | 2.49 | 1.24X |

TABLE VII-continued

| High Intensity Daylight Fade of PVA Coated PCP Dispersions of Coupler (C-2) | | | | | | |
|---|---|---|---|---|---|---|
| | | g PVA | 2 Wks | 4 Wks. | | |
| Example | Description | g (C-2) | Dye Stab. Factor | Dye Stab. Factor | $t_{30}$ in Weeks | Based on $t_{30}$ |
| | Example-6 | | | | | |

$t_{30}$: Time in weeks required to exhibit 30% dye density fade from the density of 1.0 based upon a quadratic fit of 2 wk and 4 wk data.

The HID dye fade data of Table VI was analyzed by SAS General Linear Model (GLM) procedure. The GLM procedure uses the method of least squares to fit general linear models. Among the statistical methods available in GLM are regression, analysis of variance, analysis of covariance, multivariate analysis of variance, and partial correlation. PROC GLM analyzes data within the framework of General Linear Models, hence, the name GLM. GLM handles classification variables, which have discrete levels, as well as continuous variables, which measure quantities. Thus, GLM can be used for many different analyses including:

* simple regression
* multiple regression
* analysis of variance (ANOVA), especially for unbalanced data
* analysis of covariance
* response-surface models
* weighted regression
* polynomial regression
* partial correlation
* multivariate analysis of variance (MANOVA)
* repeated measures analysis of variance

[SAS User's Guide: Statistics, "Version 5, Edition, SAS Institute, NC (1985)]

The control fade data of Example 8 was best fitted by the following quadratic model:

$$\Delta D = -0.250W - 0.050W^2 \quad (1)$$

where, ΔD is the loss in dye density due to fade from a density of 1.0 and W is the time in weeks of the exposure. With 0-, 2-, and 4-week fade, the fit is perfect characterized by a value for $R^2$ of 1.00. $R^2$ is a well-known statistical parameter that determines the quality of the fit of a model to actual data and for a perfect fit its value is 1 and poorer the fit, the more it deviates below 1. The dye fade data for the PVA coated samples were also fitted to a model where the response variable was ΔD, the extent of fade from a density of 1.0 and the independent variables were time, W in weeks and P the weight of PVA in g per g of (C-2). Best fit was obtained with the following model:

$$\Delta D = -0.122W - 0.002P - 0.110W^2 + 0.041W \quad (2)$$

Figure 4:
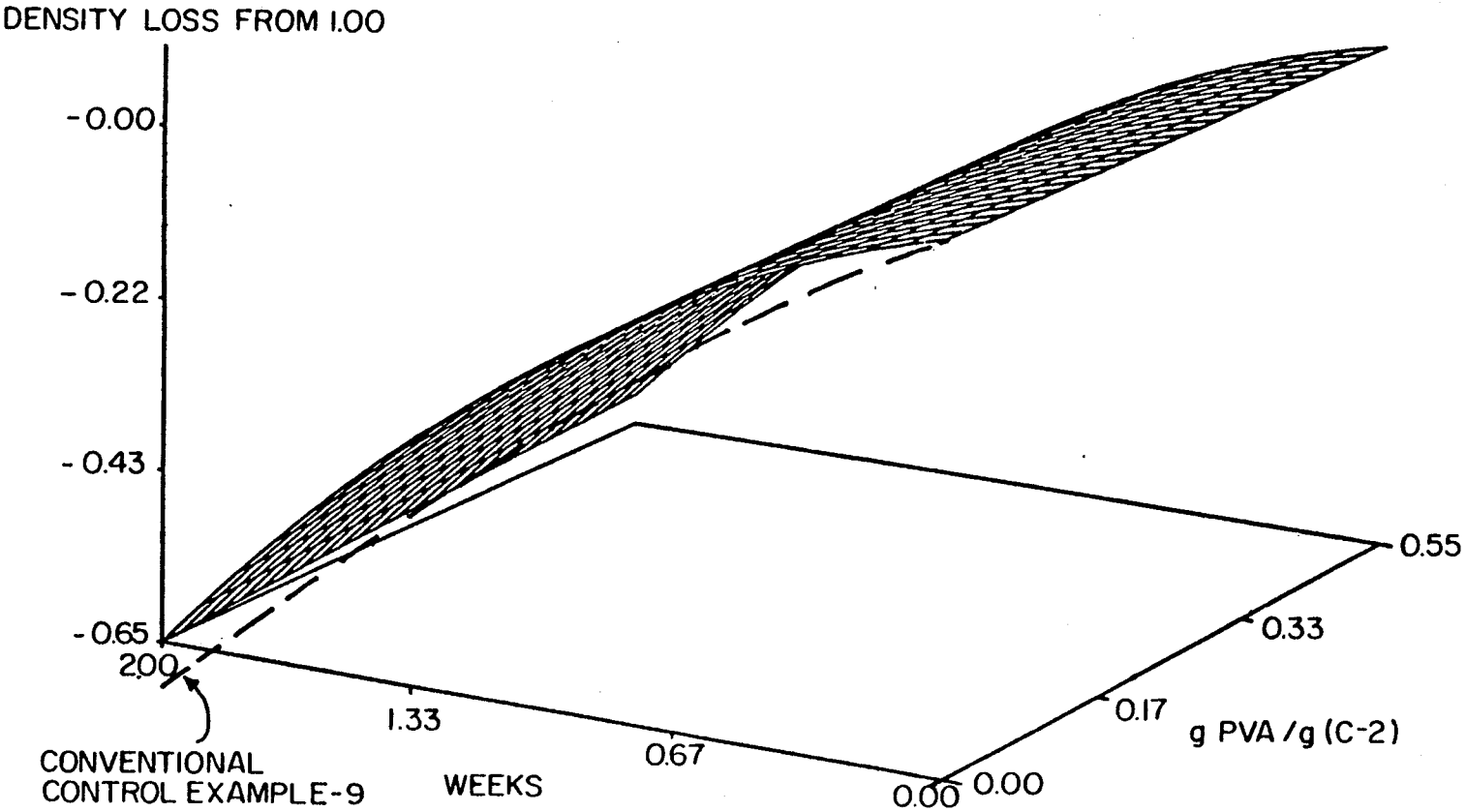
FIG. 4 shows response surface for high intensity daylight magenta dye fade from a density of 1.0 of polyvinyl alcohol coated coupler (C-2) dispersion coatings, of Examples 10–14.
Figure 5:
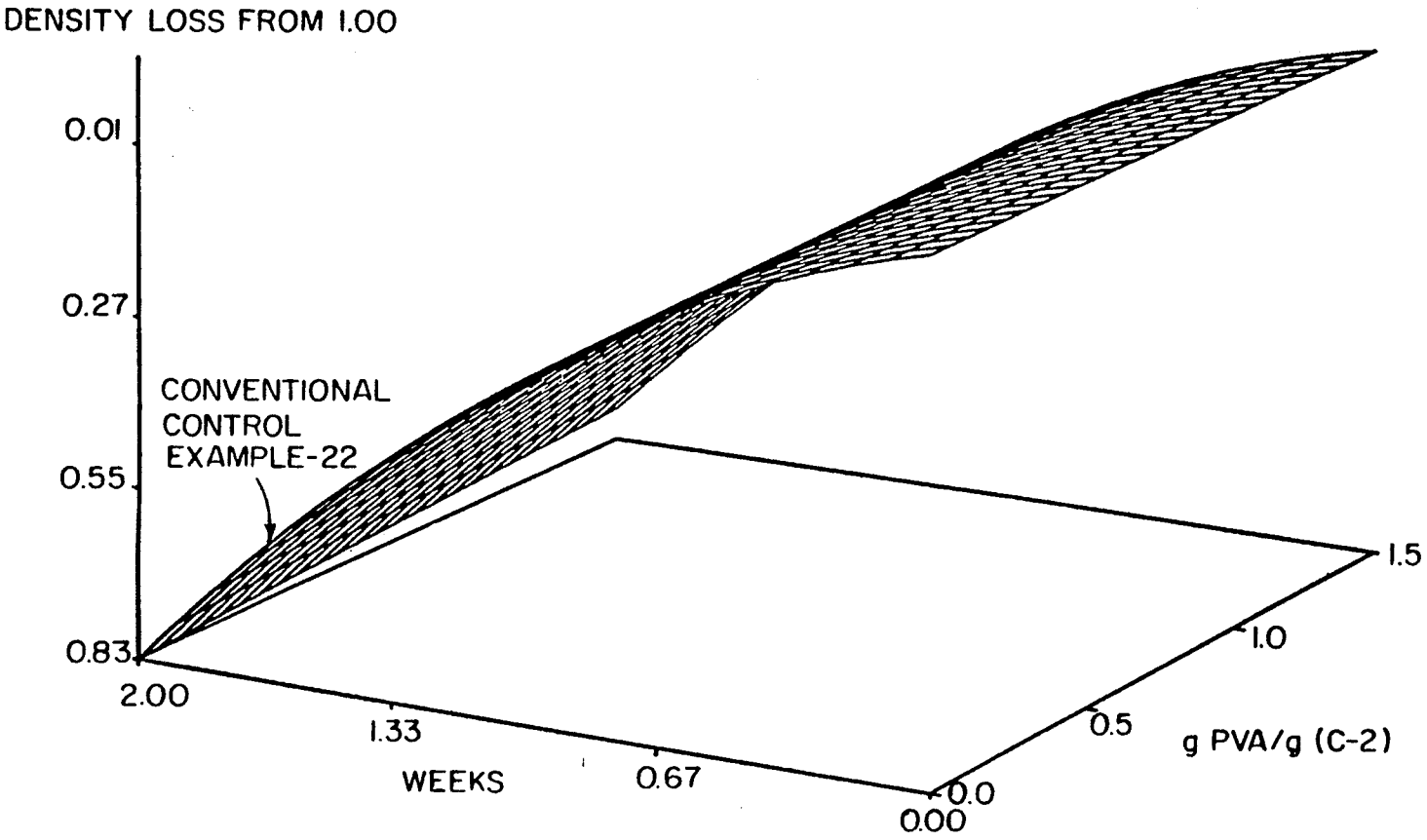
FIG. 5 shows response surface for high intensity daylight magenta dye fade from a density of 1.0 of polyvinyl alcohol coated microprecipitated dispersions of Examples 23–36.

An $R^2$ value of 0.999 was computed indicating excellent fit of the data to the model. A 3-dimensional plot of the response surface generated by Equation (2), along with the control curve of Equation (1), is shown in FIG. 4. It clearly shows that the response surface of the PVA coated PCP dispersion lies above the control line of Example 9, indicating higher dye stability of such dispersions of this invention compared to the case where dye was formed from a conventional dispersion of coupler (C-2), indicating proof of reduction to practice of this invention. It is also to be noted that the response surface of the invention is tilted towards less density loss. Increased dye stability with the increase of PVA content again reconfirms the efficacy of this invention.

EXAMPLES 15–16

Preparation of Microprecipitated Co-Dispersions of Coupler (C-2) Containing Stabilizer (ST-1) and Scavenger (SC-1)

The microprecipitated co-dispersion of Examples 15 and 16 were prepared in the equipment of FIG. 2, which has been described earlier. The various solutions used for the precipitation are listed in Table VIII. The coupler solution of Table VIII (prepared under a nitrogen blanket) was placed in kettle 100 of the semicontinuous microprecipitation equipment of FIG. 2 under a nitrogen blanket, and the surfactant/PVA solution was placed in the reaction kettle 104. Stirrer was turned on. The acid kettle filled with 15% propionic acid. Stirrer 116 was maintained at 2000 rpm. The basic coupler solution was pumped into the reaction kettle at 20 mg/min. The pH-controller was set at 6.0, which controlled the pH by turning the acid pump on as the pH went over 6.0, and off as the pH fell below 6.0. In effect, pH was controlled to 6.0±2 as determined the strip chart recorder 130. Precipitation was carried out at room temperature. After precipitation the resultant dispersion was washed by dialysis against distilled water for 24 hours. The analytical characteristics of these dispersions are listed in Table IX. It is observed in Table IX, that in both Examples 15 and 16, the experimentally measured ratios of coupler (C-2) : Stabilizer (ST-1) : Scavenger (SC-1) was very close to the theoretically expected ratio of 1:0.43:0.10, indicating insignificant decomposition of the components during the precipitation procedure.

TABLE VIII

| Preparation of the Microprecipitated Co-Dispersion of Coupler (C-2), Stabilizer (ST-1) and Scavenger (SC-1) | | | | | | | | | | | |
|---|---|---|---|---|---|---|---|---|---|---|---|
| | Coupler Solution[1] | | | | | | Surfactant/PVA Solution[5] | | | | Neutralization pH |
| Example | (C-2) (g) | (ST-1) (g) | (SC-1) (g) | 20% NaOH (g) | Propanol (g) | Dissolution temp °C. | Water (g) | SDS[2] (g) | APG625[3] (g) | PVA[4] (g) | Using 15% Propionic Acid |
| 15 | 13.1 | 5.6 | 1.3 | 5 | 40 | 45 | 500 | 3 | 10 | 10 | 6.0 |

TABLE VIII-continued

| Preparation of the Microprecipitated Co-Dispersion of Coupler (C-2), Stabilizer (ST-1) and Scavenger (SC-1) | | | | | | | | | | | |
|---|---|---|---|---|---|---|---|---|---|---|---|
| | Coupler Solution[1] | | | | | | Surfactant/PVA Solution[5] | | | | |
| Example | (C-2) (g) | (ST-1) (g) | (SC-1) (g) | 20% NaOH (g) | Propanol (g) | Dissolution temp °C. | Water (g) | SDS[2] (g) | APG625[3] (g) | PVA[4] (g) | Neutralization pH Using 15% Propionic Acid |
| 16 | 13.1 | 5.6 | 1.3 | 5 | 40 | 45 | 500 | 3 | 10 | 20 | 6.0 |

[1]Under nitrogen blanket to prevent decomposition of (SC-1) areal oxidation cooled to room temperature after dissolution.
[2]Sodium dodecyl sulfate.
[3]Alkyl polyglycoside - 50% in water. APG 225 is made by Henkel Corporation.
[4]PVA in Air vol 107 made by Air Products.
[5]Mixed at room temperature and allowed to stir for 20 hr, then dissolved at 80° C. and cooled to room temperature.

TABLE IX

| Characteristics of the Dispersions of Examples 15 and 16 | | | | | | | | | | | |
|---|---|---|---|---|---|---|---|---|---|---|---|
| | Hydrodynamic Diameter in nm by PCS | g PVA g (C-2) as prepared | High Pressure Liquid Chromatography Results | | | | | | Theoretically Expected | | |
| Example | | | % (C-2) | g (C-2) / g (C-4) | % (ST-1) | g (ST-1) / g (C-2) | % (SC-1) | g (SC-1) / g (C-2) | g (C-2) / g (C-2) | g (ST-1) / g (C-2) | g (SC-1) / g (C-2) |
| 17 | 27 | 0.76 | 1.9 | 1.00 | 0.9 | 0.47 | 0.18 | 0.09 | 1.00 | 0.43 | 0.10 |
| 18 | 44 | 1.53 | 1.5 | 1.00 | 0.7 | 0.47 | 0.13 | 0.09 | 1.00 | 0.43 | 0.10 |

EXAMPLES 17-21

Preparation of Solvent Dispersions

In the photographic testing of the microprecipitated dispersions of Examples 15 and 16, five different solvents were used. These are as follows:

Butylbenzyl phthalate

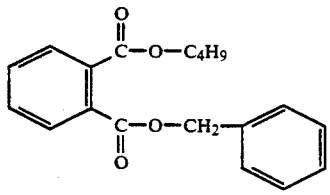

(SV-4)

Isopropyl palmitate

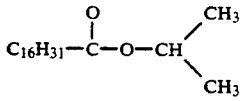

(SV-6)

Tri-(2-ethylhexyl phosphate)

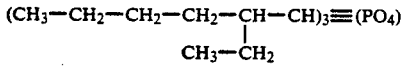

(SV-7)

Conventional solvent dispersions of the above solvents were prepared by conventional milling procedures described earlier. The compositions of these blank solvent dispersions were as shown in Table VII.

TABLE X

| Preparation of Blank Solvent Dispersions of Examples 17-21 | | | | | |
|---|---|---|---|---|---|
| Example | Solvent | g Solvent | g of 20% Gel Solution | g $H_2O$ | g of 10% Alkanol-XC |
| 17 | (SV-4) | 9.5 | 15 | 22.6 | 2.9 |
| 18 | (SV-5) | 9.5 | 15 | 22.6 | 2.9 |
| 19 | (SV-6) | 9.5 | 15 | 22.6 | 2.9 |
| 20 | (SV-7) | 9.5 | 15 | 22.6 | 2.9 |
| 21 | (SV-1) | 9.5 | 15 | 22.6 | 2.9 |

EXAMPLES 22-36

Coating and Photographic Evaluation of the Microprecipitated Dispersions of Coupler (C-2) in Examples 15 and 16

All coatings were made according to the model monochrome magenta format shown in Table IV. The control coating of the conventional dispersion of coupler (C-2) was prepared using the dispersion of Example 8. All the coatings of the microprecipitated dispersions were prepared using the dispersions of Examples 15 and 16 and the solvent dispersions of Examples 17-21 in a similar manner as described in Examples 9-14. Table XI describes the compositions of the coatings of Examples 22-36. The finished coatings were exposed to green light using a stepwedge and processed by RA-4 processing. The results of the fresh sensitometry of these coatings are listed in Table XI. The results of Table XI indicate that within normal variability, the fresh sensitometry, in terms of D-min, gradient, and speed are very similar to each other. Slightly larger variability was observed for the D-max values. However, these are probably characteristic of the specific solvents used and are of no consequence to the reduction to practice of this invention. The UV absorbing layer was the same as described earlier.

TABLE XI

| Sensitometric Data of PVA Coated MPS Dispersions of Coupler (C-2) | | | | | | | | |
|---|---|---|---|---|---|---|---|---|
| Example | Disp. ID | g PVA g (C-2) | g Solvent g (C-2) | Solvent | Green D-max | Green D-min | Average Gradient | Speed |
| 22 (Control) | Example-8 | 0.00 | 0.50 | (SV-1) | 2.48 | 0.07 | 2.72 | 155 |
| 23 | Example-15 | 0.76 | 0.50 | (SV-4) | 2.45 | 0.07 | 2.79 | 160 |
| 24 | Example-15 | 0.76 | 0.50 | (SV-5) | 2.40 | 0.07 | 2.69 | 158 |
| 25 | Example-15 | 0.76 | 0.50 | (SV-6) | 2.45 | 0.07 | 2.77 | 160 |

TABLE XI-continued

| Sensitometric Data of PVA Coated MPS Dispersions of Coupler (C-2) | | | | | | | | |
|---|---|---|---|---|---|---|---|---|
| | | g PVA | g Solvent | | Green | | Average | |
| Example | Disp. ID | g (C-2) | g (C-2) | Solvent | D-max | D-min | Gradient | Speed |
| 26 | Example-15 | 0.76 | 0.50 | (SV-7) | 2.48 | 0.07 | 2.96 | 161 |
| 27 | Example-15 | 0.76 | 0.50 | (SV-1)(1) | 2.49 | 0.07 | 2.78 | 159 |
| 28 | Example-15 | 0.76 | 0.50 | (SV-1)(2) | 2.49 | 0.07 | 2.80 | 158 |
| 29 | Example-15 | 0.76 | 1.85 | (SV-6) | 2.43 | 0.07 | 2.83 | 161 |
| 30 | Example-15 | 0.76 | 1.85 | (SV-7) | 2.47 | 0.07 | 3.01 | 162 |
| 31 | Example-15 | 0.76 | 1.85 | (SV-1) | 2.58 | 0.07 | 2.85 | 159 |
| 32 | Example-16 | 1.53 | 0.50 | (SV-4)(1) | 2.36 | 0.07 | 2.63 | 158 |
| 33 | Example-16 | 1.53 | 0.50 | (SV-5) | 2.32 | 0.07 | 2.52 | 157 |
| 34 | Example-16 | 1.53 | 0.50 | (SV-4)(2) | 2.38 | 0.08 | 2.64 | 158 |
| 35 | Example-16 | 1.53 | 0.50 | (SV-7) | 2.42 | 0.07 | 2.80 | 160 |
| 36 | Example-16 | 1.53 | 0.50 | (SV-1) | 2.40 | 0.07 | 2.67 | 158 |

Number within parenthesis for solvents indicate repeat runs of (C-2)/(ST-1)/(SC-1)
In all coatings, weight ratio was the same as 1:0.43:0.10

The coatings of Examples 22–36 were tested for light stability under the following conditions:

* 2 and 4 weeks in High Intensity Daylight, 50 Klux
* 2 and 4 weeks in High Intensity Sunshine, 50 Klux The results (as in the case of the PCP dispersions) are tabulated in Table XII. The results indicate that the PVA coated particles do indeed impart improved stability of dye fade when exposed to the indicated illumination conditions. However, the gain in dye stability in the case of the PVA coated microprecipitated dispersions are not as large as in the case of the PCP dispersions. In the case of the microprecipitated dispersions, the dye stability gains as seen in Table XII are of the order of 15 to 20% with a few exceptions. The best dye stability was observed with (SV-7) solvent at a solvent to (C-2) ratio of 1.85. Under these conditions, (SV-7) dispersions with PVA coat showed 42% greater dye stability than the normal conventional control (Example 22).

The model gave an $R^2$ value of 0.999 indicating excellent fit of the data with the model. The ΔD response surface is pictionally shown in FIG. 6. It indicates that as PVA/(C-2) ratio increases, the response surfaces curves upwards to smaller ΔD values for less dye fade. This is considered confirmation and reduction to practice of the invention for the case of microprecipitated dispersions, even though the effect was not as large as that for the polymer coprecipitated dispersions.

The invention has been described in detail with particular reference to preferred embodiments thereof, but it will be understood that variations and modifications can be effected within the spirit and scope of the invention.

What is claimed is:

1. A method of forming particles comprising forming a dispersion of particles of photographically active material by solvent shift precipitation from aqueous solution, and adding an oxygen barrier layer material selected from the group consisting of sorbitol, polyvinyl alcohol, and ethylenically linked copolymer containing at least 10 percent of vinyl alcohol monomer by weight to said dispersion wherein said solvent shift precipitation is carried out by providing a first flow of water, base, a base swellable polymer latex dispersion and a surfactant, a second flow comprising a water miscible

TABLE XII

| Dye Fade Data of PVA Coated PCP Dispersions Coupled (C-2) | | | | | | | | | | | | |
|---|---|---|---|---|---|---|---|---|---|---|---|---|
| | | | | | HID (4 wks) | HID (2 wks) | HIS (4 wks) | HIS (2 wks) | HID (2 Wks) | | HIS (2 Wks) | |
| Example | Dispersion ID | g PVA g (C-2) | g Solvent g (C-2) | Solvent | Δ Density from 1.0 | Δ Density from 1.0 | Δ Density from 1.0 | Δ Density from 1.0 | $t_{30}$ in Weeks | Dye Stability Factor | $t_{30}$ in Weeks | Dye Stability Factor |
| 22 (Control) | Example-8 | 0.00 | 0.50 | (SV-1) | −0.81 | −0.30 | −0.60 | −0.26 | 2.00 | 1.00X | 2.26 | 1.00X |
| 23 | Example-15 | 0.76 | 0.50 | (SV-4) | −0.80 | −0.24 | −0.62 | −0.23 | 2.28 | 1.14X | 2.43 | 1.08X |
| 24 | Example-15 | 0.76 | 0.50 | (SV-3) | −0.78 | −0.21 | −0.56 | −0.19 | 2.42 | 1.21X | 2.71 | 1.20X |
| 25 | Example-15 | 0.76 | 0.50 | (SV-6) | −0.79 | −0.23 | −0.59 | −0.21 | 2.33 | 1.16X | 2.56 | 1.13X |
| 26 | Example-15 | 0.76 | 0.50 | (SV-7) | −0.81 | −0.29 | −0.65 | −0.27 | 2.05 | 1.02X | 2.18 | 0.96X |
| 27 | Example-15 | 0.76 | 0.50 | (SV-1)(1) | −0.82 | −0.26 | −0.63 | −0.24 | 2.19 | 1.10X | 2.37 | 1.05X |
| 28 | Example-15 | 0.76 | 0.50 | (SV-1)(2) | −0.82 | −0.27 | −0.64 | −0.24 | 2.14 | 1.07X | 2.36 | 1.04X |
| 29 | Example-15 | 0.76 | 1.85 | (SV-6) | −0.82 | −0.22 | −0.59 | −0.20 | 2.36 | 1.18X | 2.62 | 1.16X |
| 30 | Example-15 | 0.76 | 1.85 | (SV-7) | −0.77 | −0.15 | −0.45 | −0.13 | 2.65 | 1.33X | 3.20 | 1.42X |
| 31 | Example-15 | 0.76 | 1.85 | (SV-1) | −0.85 | −0.22 | −0.66 | −0.19 | 2.35 | 1.18X | 2.59 | 1.15X |
| 32 | Example-16 | 1.53 | 0.50 | (SV-4)(1) | −0.80 | −0.26 | −0.60 | −0.22 | 2.19 | 1.10X | 2.50 | 1.11X |
| 33 | Example-16 | 1.53 | 0.50 | (SV-5) | −0.76 | −0.22 | −0.54 | −0.19 | 2.39 | 1.20X | 2.73 | 1.21X |
| 34 | Example-16 | 1.53 | 0.50 | (SV-4)(2) | −0.79 | −0.27 | −0.60 | −0.22 | 2.15 | 1.08X | 2.50 | 1.11X |
| 35 | Example-16 | 1.53 | 0.50 | (SV-7) | −0.78 | −0.29 | −0.60 | −0.24 | 2.05 | 1.02X | 2.39 | 1.06X |
| 36 | Example-16 | 1.53 | 0.50 | (SV-1) | −0.77 | −0.24 | −0.58 | −0.20 | 2.30 | 1.15X | 2.63 | 1.16X |

Number within parenthesis for solvents indicate repeat runs.

In the case of the microprecipitated dispersions, the zero PVA can be considered to be the control X conventional milled dispersion coating of Example 22, as there is no precipitation polymer involved in any of these dispersions. Therefore, the dye fade data for a particular solvent such as those containing (SV-1) at a level of 0.50 g of (SV-1) g of (C-2) can be analyzed by PROC GLM as before. In this case, the response surface for ΔD is best represented by the model:

$$\Delta D = -0.150W + 0.004P - 0.132W^2 + 0.016WP \quad (3)$$

auxiliary solvent base and photographically active material.

2. The method of claim 1 wherein said solvent shift precipitation is carried out by providing a first flow of water and a surfactant, providing a second flow comprising water miscible auxiliary solvent, base and said photographically active material, and combining said first stream and said second stream to precipitate said particles.

3. The method of claim 1 wherein said photographically active material comprises coupler.

4. The method of claim 1 wherein said particles are between about 5 and about 50 nm in diameter.

5. The method of claim 1 wherein said oxygen barrier material consists of polyvinyl alcohol added in an amount of between about 5 and about 70 parts by weight of photographically active material.

6. The method of claim 5 wherein said polyvinyl alcohol has a molecular weight of between $10^3$ and $10^7$ Daltons.

7. The method of claim 6 wherein said polyvinyl alcohol is at least 80 percent hydrolyzed.

8. The method of claim 1 wherein said oxygen barrier material consists of said ethylenically linked polymer containing vinyl alcohol monomer.

9. The method of claim 1 wherein said oxygen barrier material consists of said sorbitol.

* * * * *